US011441381B2

(12) United States Patent
Moya et al.

(10) Patent No.: US 11,441,381 B2
(45) Date of Patent: Sep. 13, 2022

(54) BLOWOUT PREVENTER SYSTEM AND METHOD

(71) Applicant: Baker Hughes Oilfield Operations LLC, Houston, TX (US)

(72) Inventors: Ronny Moya, Houston, TX (US); Elliot Yendell, Houston, TX (US); Ramon Deluna, Houston, TX (US)

(73) Assignee: Hydril USA Distribution LLC, Houston, TX (US)

( * ) Notice: Subject to any disclaimer, the term of this patent is extended or adjusted under 35 U.S.C. 154(b) by 0 days.

(21) Appl. No.: 17/002,141

(22) Filed: Aug. 25, 2020

(65) Prior Publication Data

US 2021/0062608 A1 Mar. 4, 2021

Related U.S. Application Data

(63) Continuation-in-part of application No. 16/552,390, filed on Aug. 27, 2019, now abandoned, and a continuation-in-part of application No. 16/552,397, filed on Aug. 27, 2019, now abandoned.

(51) Int. Cl.
*E21B 33/06* (2006.01)

(52) U.S. Cl.
CPC ..... *E21B 33/063* (2013.01)

(58) Field of Classification Search
CPC ..... E21B 33/06; E21B 33/061; E21B 33/062; E21B 33/063; E21B 33/064
See application file for complete search history.

(56) References Cited

U.S. PATENT DOCUMENTS 3,658,287 A * 4/1972 Lerouax ..... E21B 33/062 251/1.3
5,897,094 A * 4/1999 Brugman ..... E21B 33/062 251/1.3
5,975,484 A * 11/1999 Brugman ..... E21B 33/062 251/1.3
8,479,825 B2 * 7/2013 Childers ..... E21B 19/00 166/360

(Continued)

FOREIGN PATENT DOCUMENTS

CN 105927181 A * 9/2016
CN 106499358 A * 3/2017 ..... E21B 33/062
WO WO-2021156476 A1 * 8/2021 ..... E21B 34/02

*Primary Examiner* — Jennifer H Gay
(74) *Attorney, Agent, or Firm* — Osha Bergman Watanabe & Burton LLP

(57) ABSTRACT

A blowout preventer (BOP) for controlling pressure within a wellbore includes an internal cavity and a front side including a door opening, the door opening providing access to the internal cavity. The BOP also includes a door assembly associated with the door opening. The door assembly includes a door, movable between a first position and a second position, the door blocking access to the internal cavity in the first position and enabling access to the internal cavity in the second position. The door assembly also includes a hinge coupled to the door to facilitate movement of the door between the first position and the second position. The door assembly further includes a coupling device associated with the door, the coupling device securing the door to the front side. The BOP also includes a back side including an outlet, the outlet being fluidly coupled to the internal cavity.

18 Claims, 32 Drawing Sheets

(56) References Cited

U.S. PATENT DOCUMENTS

| | | | | |
|---|---|---|---|---|
| 9,045,961 | B2 * | 6/2015 | Melancon | E21B 33/06 |
| 9,732,577 | B2 * | 8/2017 | Holland, Jr. | E21B 33/062 |
| 2011/0048736 | A1 * | 3/2011 | Childers | E21B 19/00<br>166/379 |
| 2012/0193874 | A1 * | 8/2012 | Melancon | E21B 33/06<br>277/314 |
| 2016/0084031 | A1 * | 3/2016 | DeOcampo | E21B 33/062<br>166/373 |
| 2017/0067309 | A1 * | 3/2017 | Holland, Jr. | E21B 33/062 |
| 2020/0208488 | A1 * | 7/2020 | Bobeck | E21B 33/06 |
| 2021/0062606 | A1 * | 3/2021 | Moya | E21B 33/063 |
| 2021/0062607 | A1 * | 3/2021 | Moya | E21B 33/063 |
| 2021/0062608 | A1 * | 3/2021 | Moya | E21B 33/063 |

* cited by examiner

BLOWOUT PREVENTER SYSTEM AND METHOD

CROSS REFERENCE TO RELATED APPLICATIONS

This application is a continuation-in-part of U.S. patent application Ser. No. 16/552,390, titled "BLOWOUT PREVENTER SYSTEM AND METHOD," filed Aug. 27, 2019 and is a continuation-in-part of U.S. patent application Ser. No. 16/552,397, titled "BLOWOUT PREVENTER SYSTEM AND METHOD," filed Aug. 27, 2019, the full disclosures of which are hereby incorporated by reference in their entireties for all purposes.

BACKGROUND OF THE DISCLOSURE

1. Field of the Disclosure

This disclosure relates in general to oil and gas tools, and in particular, to systems and methods for sealing across lines or pipes.

2. Brief Description of Related Art

In oil and gas production, drilling and recovery may occur in high pressure environments where various tools may be utilized to control wellbore pressures. For example, a blowout preventer (BOP) or the like may be arranged at an entrance to the wellbore. During operations, equipment may pass through the blowout preventer and, if necessary, the blowout preventer may be utilized to seal the wellbore to reduce the likelihood of uncontrolled releases from the wellbore. One component of the blowout preventer may be a shear ram. The shear ram may be a hydraulically driven component that drives cutting edges of two components toward one another to contact and shear and/or seal across the components between, such as wirelines or piping. The shear rams within the BOPs may undergo maintenance operations, and installation and removal may be time consuming and dangerous due to the configuration of many BOPs.

SUMMARY OF THE DISCLOSURE

Applicants recognized the problems noted above herein and conceived and developed embodiments of systems and methods, according to the present disclosure, for BOPs.

In an embodiment, a blowout preventer (BOP) for controlling pressure within a wellbore includes an internal cavity and a front side including a door opening, the door opening providing access to the internal cavity. The BOP also includes a door assembly associated with the door opening. The door assembly includes a door, movable between a first position and a second position, the door blocking access to the internal cavity in the first position and enabling access to the internal cavity in the second position. The door assembly also includes a hinge coupled to the door to facilitate movement of the door between the first position and the second position. The door assembly further includes a coupling device associated with the door, the coupling device securing the door to the front side. The BOP also includes a back side including an outlet, the outlet being fluidly coupled to the internal cavity.

In another embodiment, a blowout preventer (BOP) for controlling pressure within a wellbore includes an internal cavity and a front side including a door opening, the door opening providing access to the internal cavity. The BOP also includes a door associated with the door opening, the door being movable between a first position and a second position, the door blocking access to the internal cavity in the first position and enabling access to the internal cavity in the second position. The BOP further includes a hinge coupled to the door. The hinge includes a hinge body, the hinge body secured to a body of the BOP. The hinge also includes a hinge coupling coupled to the door. The hinge further includes a rotation mechanism arranged at an interface between the hinge body and the hinge coupling, the rotational mechanism securing the door in the second position or in a third position, the third position enabling access to the internal cavity.

In an embodiment, a door assembly for providing access to an internal cavity of a blowout preventer (BOP) includes a door associated with a door opening, the door being movable between a first position and a second position, the door blocking access to the internal cavity in the first position and enabling access to the internal cavity in the second position. The door assembly also includes a hinge coupled to the door. The hinge includes a hinge body and a hinge coupling coupled to the door. The hinge also includes a rotation mechanism arranged at an interface between the hinge body and the hinge coupling, the rotational mechanism securing the door in the second position or in a third position, the third position enabling access to the internal cavity.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE PREFERRED EMBODIMENT

Figure 1:
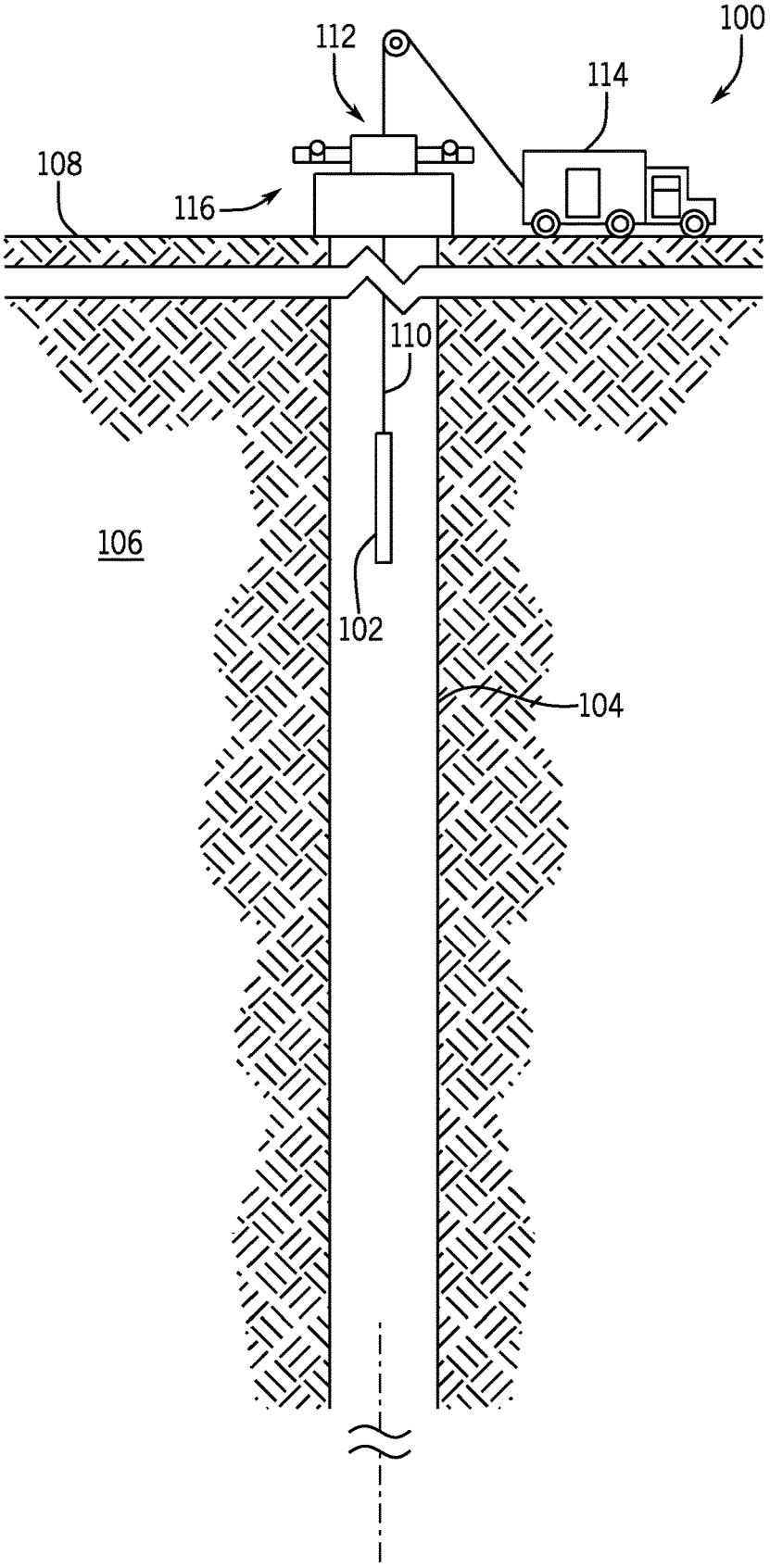
FIG. 1 is a side elevation view of an embodiment of a wellbore system, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure include a blowout preventer (BOP) configuration to facilitate loading and unloading of ram blocks while also maintaining structural integrity for high-pressure operating conditions. In various embodiments, the BOP includes a hinged design door opening to facilitate installation and removal of the rams from an internal cavity of the BOP. In embodiments, at least a portion of the door, such as a door extension, may be incorporated into removal procedures. The door may pivot away from a body of the BOP, for example about an axis, to facilitate removal and installation of the ram blocks. Furthermore, in various embodiments, the doors may be structured to accommodate the operating pressure while also reducing an overall weight of the doors.

In various embodiments of the present disclosure, the body of the BOP may include an elongated top seat that extends through at least a portion of the body. The top seat may be arranged perpendicularly with respect to an opening associated with the doors. In certain embodiments, a machining tool having a 90-degree cutting head may be utilized to form at least a portion of the top seat. In embodiments, the machining tool may be installed through the opening and then used to machine at least a portion of the top seat. In operation, a ram block may translate within a passage formed by the machining tool, which includes the top seat, to translate from a disengaged position to an engaged position. In the engaged position, the ram block may be used to cut wireline or tubulars to control pressure within a wellbore.

In various embodiments, the body of the BOP may be machined to provide reinforcing ribs at various locations to accommodate anticipated operating conditions while also removing material in other areas to reduce an overall weight of the BOP. Additionally, various inlet and outlet passages may be arranged at angles to facilitate positioning of tubulars and actuators coupled to the BOP body. For example, in an embodiment, a front side of the BOP may include a strengthening rib arranged between openings associated with the door. Moreover, a back side of the BOP may include an angled face to provide an outlet. The angled face may facilitate coupling of various valves to the BOP while also minimizing interference between the valves or other coupled items.

In certain embodiments, actuators for driving the ram blocks may be coupled to the BOP body. The actuators may be installed utilizing an installation procedure that provides an indication to the operator that the actuators are coupled to the BOP. For example, at least a portion of the actuator may include a window to visually identify one or more nuts, or a portion of a thread, to determine a position of the actuator. In this manner, installation procedures may be more reliable and also simplified for operations.

Embodiments of the present disclosure are directed to BOP systems and methods for machining the body, installing rams, removing rams, and installing actuators for driving the rams. In various embodiments, components of the BOP system may be modular to facilitate different configurations. For example, the BOP system may include two rams, four rams, six rams, or any other configuration. Moreover, the BOP system may include a variety of inlets and outlets. Accordingly, it should be appreciated that various aspects of the present disclosure may be combined or adjusted to address a variety of different operating conditions.

FIG. 1 is a schematic side view of an embodiment of a wellbore system 100 that includes a tool 102 (which may be part of a tool string) being lowered into a wellbore 104 formed in a formation 106 from a surface location 108. The illustrated wellbore system 100 may be referred to as a wireline system because the tool 102 is conveyed on a cable 110, such as an electric wireline. In various embodiments, the electric wireline may transmit electric signals and/or energy from the surface location 108 into the wellbore, for example to provide operational power for the tool 102 and/or to transmit data, such as data obtained from sensors arranged on the tool 102. In various embodiments, the tool 102 may be utilized to perform downhole logging operations, such as an imaging tool, a resistivity tool, a nuclear tool, or any other logging tool that may be used in a downhole environment.

The wellbore system 100 includes a wellhead assembly 112, shown at an opening of the wellbore 104, to provide pressure control of the wellbore 104 and allow for passage of equipment into the wellbore 104, such as the cable 110 and the tool 102. In this example, the cable 110 is a wireline being spooled from a service truck 114. It should be appreciated that the cable 110 and wireline system is for illustrative purposes only, and in other embodiments, the tool 102 may be deployed along pipes or tubing. That is, a rigid or substantially rigid tool string may be deployed. The wellhead assembly 112 may include a BOP 116 (e.g., pressure control device) that comprises shear rams that may be utilized to shear components extending through BOP 116. For example, in embodiments the cable 110 may be sheared. However, in embodiments where the tool 102 is deployed on rigid or semi rigid piping, the piping may be cut, severed, crimped, or otherwise modified by the rams. For example, the rams may shear through the pipe. In other embodiments, the rams may crimp or otherwise bend the pipe such that flow is blocked. As will be described below, in various embodiments the shear rams may be energized to move from a position outside of a bore of the BOP 116 to a position within the bore of the BOP 116. The shear rams may cut the cable 110 in the illustrated embodiment to thereby facilitate closure of the wellbore 104. Furthermore, it should be appreciated that the seal rams may also shear and seal across drill pipe, casing, shear subs or combinations of pipe, control lines, tubing, hoses, and/or wireline. Accordingly, while embodiments herein may be described with respect to shearing the cable 110, embodiments may also be utilized with various other downhole deployment methods. It should be appreciated that while FIG. 1 illustrates a land operation that, in various embodiments, systems and methods of the present disclosure may also be utilized in sub-sea operations and the like. Furthermore, as noted above, the illustrated cable 110 may be replaced with rigid tubing in various embodiments.

Figure 2:
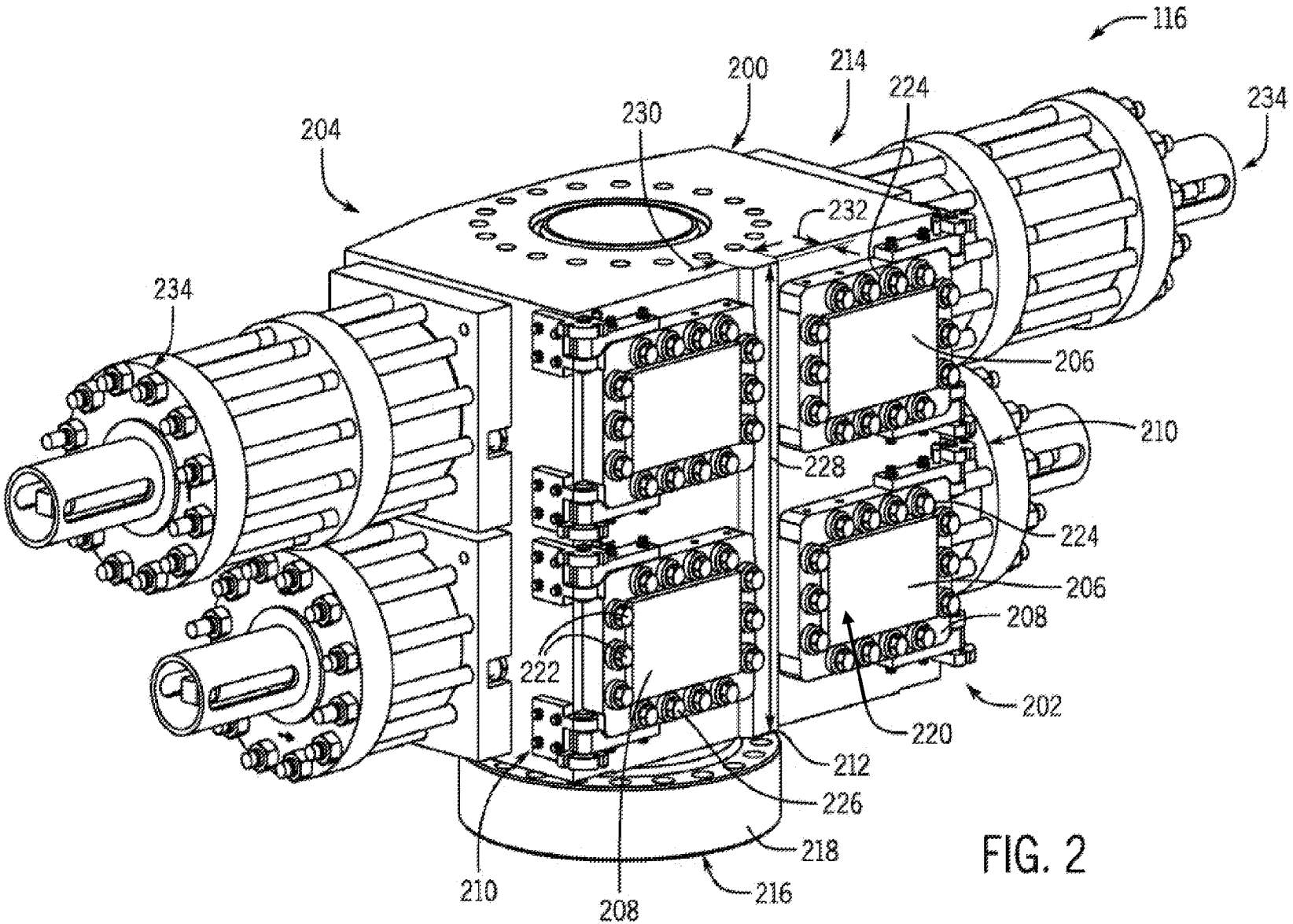
FIG. 2 is a front perspective view of an embodiment of a blowout preventer (BOP), in accordance with embodiments of the present disclosure.

FIG. 2 is a perspective view of an embodiment of the BOP 116, which may include various components to facilitate installation and removal of the rams, among other features. In the illustrated embodiment, the BOP 116 includes a body portion 200 having a front side 202 and a back side 204. It should be appreciated that "front" and "back" are described relative to the illustrated embodiment and are not intended to limit the disclosure. For example, the front side 202 is opposite the back side 204.

The front side 202 includes a plurality of door assemblies 206 that includes doors 208 and hinges 210. The illustrated embodiment includes four door assemblies 206. However, it should be appreciated that other embodiments may include 2 door assemblies 206, six door assemblies 206, or any other reasonable number. The front side 202 further includes a rib 212 that extends from a top 214 to a bottom 216. The bottom 216 is coupled to flange 218, which may facilitate coupling the BOP 116 to a wellbore. In various embodiments, the doors 208 may be configured to pivot about an axis, for example via the hinges 210, to facilitate access to an interior portion of the body 200, for example, through door openings formed in the body 200.

As will be described below, the doors 208 may include one or more reinforcement features 220 to provide structural stability in response to the operating pressures of the BOP, as well as loads or forces that may be coupled to the doors 208, such as the rams. In operation, the doors 208 may be secured to the body 200 via apertures 222 arranged about a face 224 of the doors 208. In the illustrated embodiment, the apertures 222 are positioned radially outward from the reinforcement feature 220, however, it should be appreciated that, in other embodiments, the apertures 222 may be arranged at different locations. Furthermore, the inclusion of 14 apertures receiving the fasteners 226 is for illustrative purposes only, as is the arrangement of four apertures 222 above the reinforcement feature 220 and three apertures to each side of the reinforcement feature 220. It should be appreciated that any number of apertures 222 and accompanying fasteners 226 may be utilized to secure the doors 208 to the body 200.

The embodiment of FIG. 2 also includes the rib 212 extending from the top 214 to the bottom 216. It should be appreciated that, in various embodiments, a rib length 228, a rib width 230, and/or a rib thickness 232 may be particularly selected based on operating conditions. For example, the rib length 228 may not extend from the top 214 to the bottom 216 and may extend only along a portion of the body 200. Furthermore, in embodiments, the rib thickness 232 may be adjusted. Additionally, while the rib 212 is illustrated as being substantially centered between the doors 208, it should be appreciated that the rib 212 may be arranged at different locations. Additionally, the rib 212 may include both the illustrated vertical component and another horizontal component arranged substantially perpendicular to the vertical component. Accordingly, embodiments of the present disclosure may use the rib 212 in order to provide a strengthening or reinforcement to the front side 202 of the body 200. For example, the rib 212 may stiffen the body 200, which may help accommodate stresses and forces experienced during operation, installation of the rams, or removal of the rams.

The illustrated BOP 116 further includes an operator 234, which may be referred to as a ram operator or an actuator. In various embodiments, the operator 234 drives linear movement of the ram through the body 200 of the BOP 116. As will be described below, in various embodiments the operator 234 is coupled to the body 200 to facilitate operation of the BOP 116.

Figure 3:
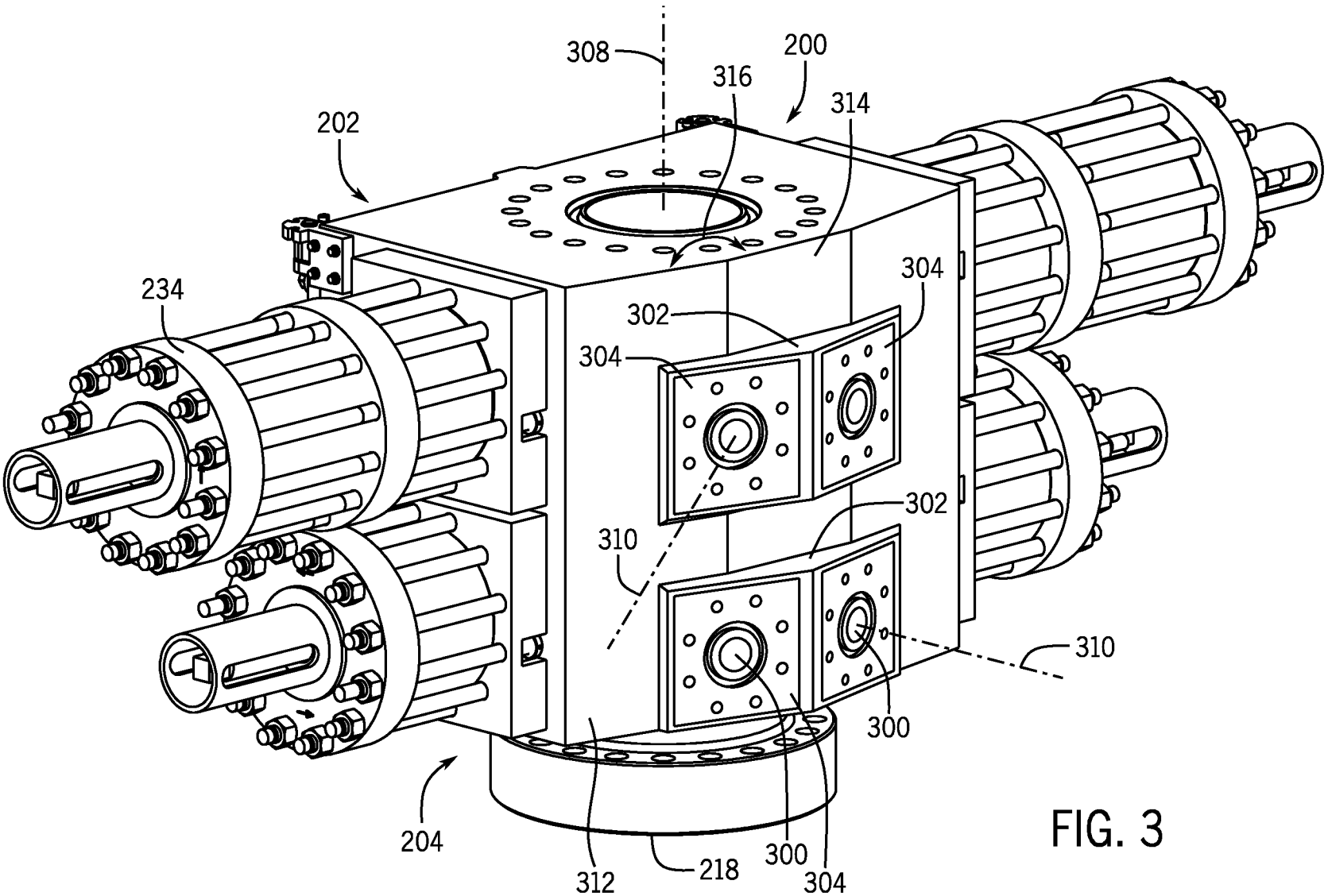
FIG. 3 is a back perspective view of an embodiment of a BOP, in accordance with embodiments of the present disclosure.

FIG. 3 is a perspective view of an embodiment of the body 200 illustrating the back side 204. As described herein, the back side 204 is opposite the front side 202. The illustrated back side 204 includes a plurality of outlets 300, which may be utilized to receive tubulars to regulate choke and/or kill of the BOP 116. It should be appreciated the while the illustrated embodiment includes four outlets 300, other embodiments may include 1, 2, 3, 5, 10, or any reasonable number of outlets 300. The outlets 300 are arranged on respective platforms 302 that extend away from the body 200. The platforms 302 may describe reinforced areas that include additional material than the body 200, which may provide further structural support. Additionally, the platforms 302 of the illustrated embodiment include respective faces 304 that are arranged at an angle 306 with respect to an axis 308 of the BOP 116. The illustrated angles 306 point centerline 310 of the outlets 300 away from one another, which may facilitate coupling additional components, such as valves and the like, to the BOP 116. That is, the angled configuration of the faces 304 may provide additional space to arrange components coupled to the faces 304. As will be appreciated, because the front side 202 includes the doors 208, which may be opened and closed for maintenance or other operations, it may be advantageous to include the outlets 300 on the back side 204, away from the doors 208, so that work on the doors 208 does not interfere with the outlets 300.

In various embodiments, the back side 204 includes a first portion 312 and a second portion 314, which are arranged at an angle 316 with respect to one another. This configuration may provide additional structural rigidity to the body 200, while still reducing the total amount of material utilized to form the BOP 116. For example, in the illustrated embodiment, the first portion 312 is arranged proximate the operators 234 and is slanted or angled. The second portion 314 is arranged between the first portions 312 and is substantially flush or aligned with the front side 202. It should be appreciated that other configurations, such as having the entire back side 204 being substantially parallel to the front side 202, may be utilized.

Figure 4:
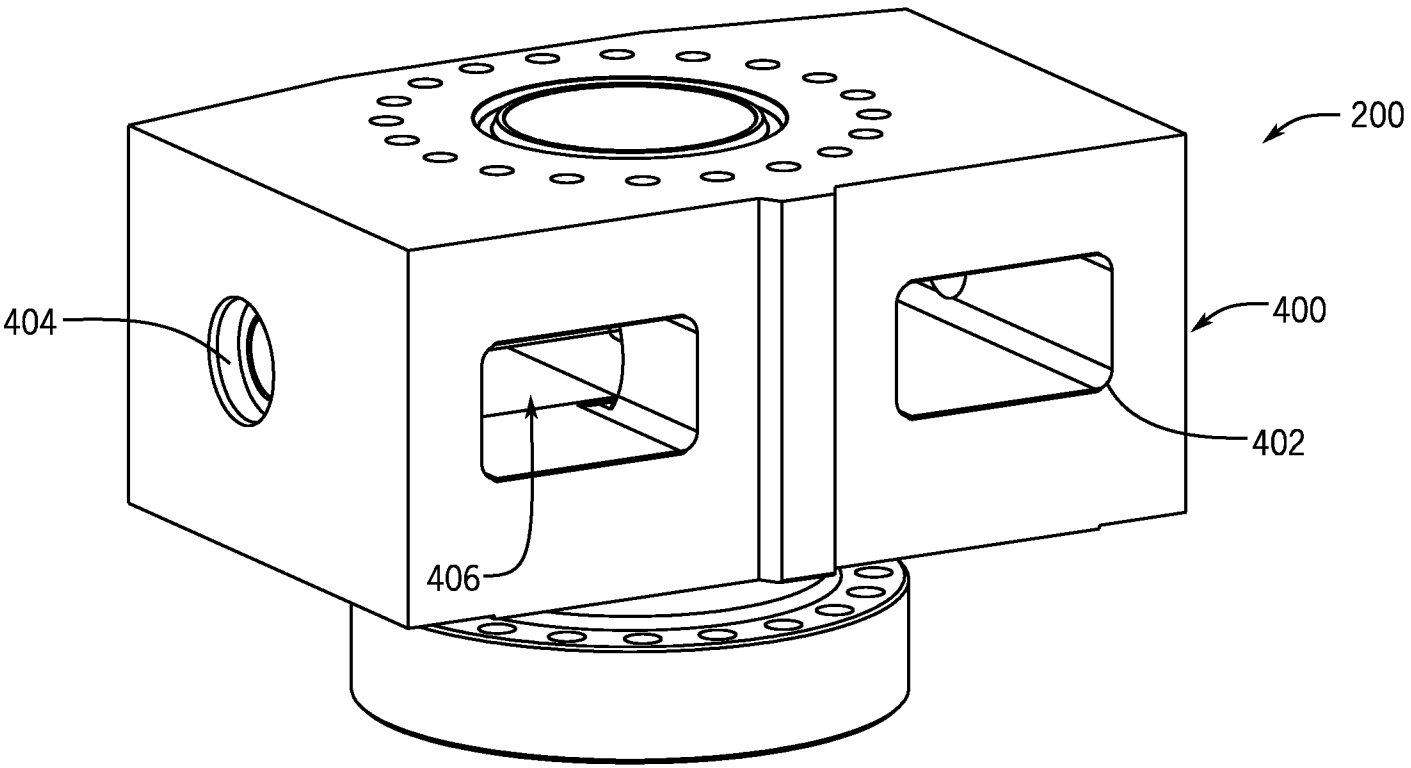
FIG. 4 is a front perspective view of an embodiment of body of a BOP, in accordance with embodiments of the present disclosure.

FIG. 4 is a perspective view of the body 200, in which various components have been removed for clarity, such as the door assemblies 206 and operators 234. The illustrated body 200 differs from the views of FIGS. 2 and 3 at least because only two door assemblies 206 would be utilized, rather than four, and only two operators 234 would be utilized. As noted above, a variety of different configurations may be utilized with embodiments of the present disclosure.

The illustrated embodiments include door openings 400 extending through the front side 202. The door openings 400 including rounded edges 402, which may facilitate with stress transfer, but it should be appreciated that the edges may be substantially 90 degrees or any other angle or finish that may be machined into the front face 202. In various embodiments, the front face 202 is machined or otherwise worked to provide the door openings 400, among other features. However, it should be appreciated that the body 200 may also be cast or formed to include the door openings 400 and/or other features.

Further illustrated in FIG. 4 is an operator opening 404, which may receive a cylinder or piston to facilitate translating movement of the rams via the operators 234. It should be appreciate that, much like the door openings 400, the operator opening 404 may be forged, machined, and/or cast into the body 200.

The illustrated body 200 includes an internal cavity 406, which as will be described below, may include a top seat that receives the ram and enables movement of the ram within the cavity 406. Furthermore, it should be appreciated that other features may be included, but have been eliminated for clarity. For example, various apertures may be formed in the body 200 to facilitate coupling of various features, such as the doors 208, hinges 210, operator 234, and other elements. Furthermore, the rib 212 has been removed for clarity, but may be positioned between the door openings 400.

Figure 5:
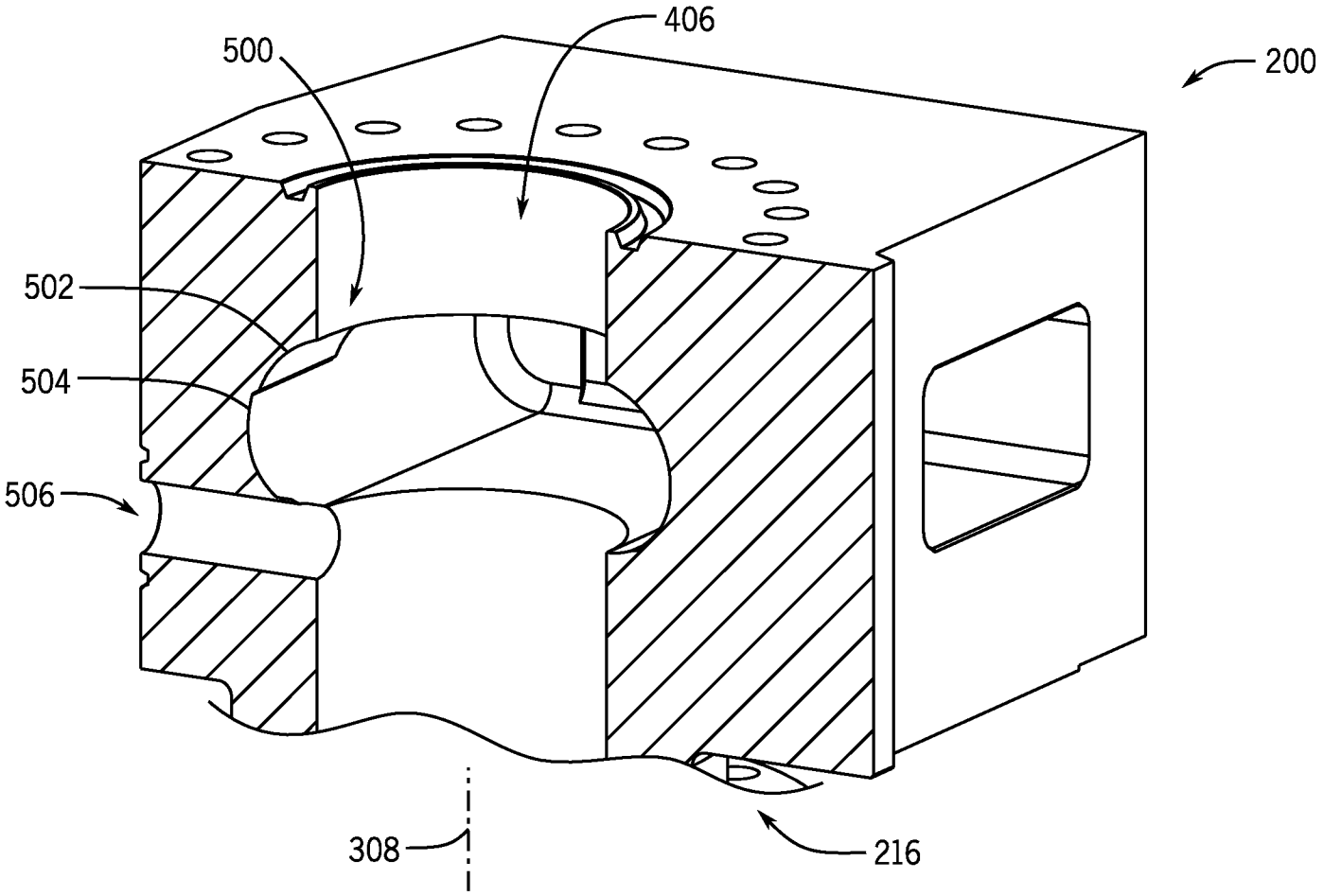
FIG. 5 is a partial sectional view of an embodiment of a BOP illustrating a ram passage, in accordance with embodiments of the present disclosure.

FIG. 5 is a sectional perspective view of an embodiment of the body 200, including the door opening 400 and a ram passage 500 within the internal cavity 406. In various embodiments, a top seat 502 may form at least a portion of the internal cavity 406 and/or the ram passage 500. The illustrated ram passage 500 is substantially rounded and may have an oval or elliptical shape. It should be appreciated that the ram passage 500 may be shaped to conform to at least a portion of the ram. As a result, a rounded edge 504 may have various features or diameter adjustments to conform to the ram.

Further illustrated in FIG. 5 is an outlet passage 506, which may couple to the outlet 300 on the back side 204. The outlet passage 506 in the illustrated embodiment is arranged longitudinally lower than the ram passage 500. That is, the outlet passage 506 is closer to the bottom 216 than the ram passage 500. In various embodiments, as will be described below, the outlet passage 506 may be arranged at an angle with respect to the axis 308. While not illustrated in FIG. 5, it should be appreciated that a variety of different surface finishes, coatings, and the like may be applied to the ram passage 500, for example along the rounded edge 504. Furthermore, a dimension of the ram passage 500 may be particularly selected based on expected operating conditions and the operator 234 selected for use.

Figure 6:
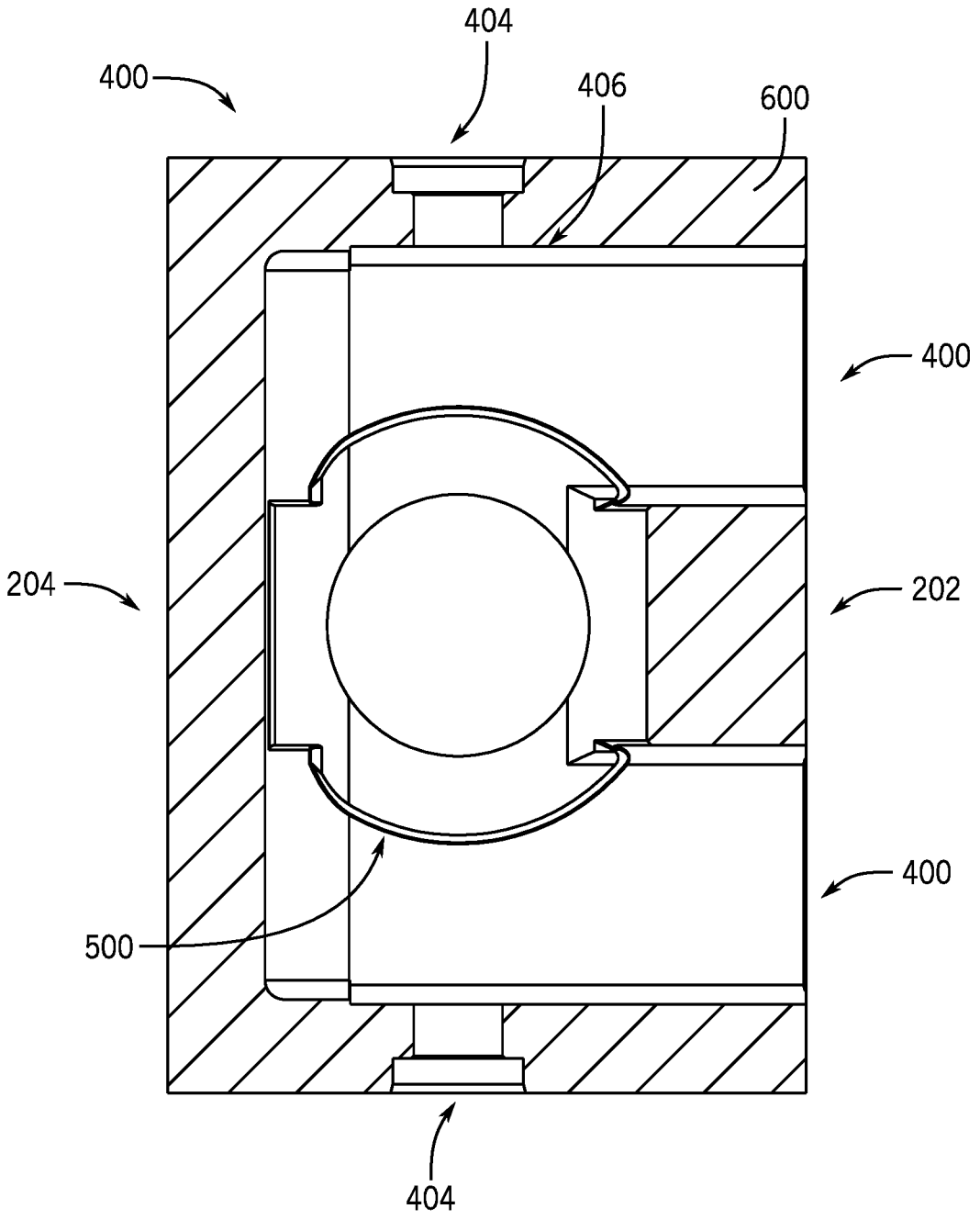
FIG. 6 is a top plan view of an embodiment of a BOP having an internal cavity, in accordance with embodiments of the present disclosure.

FIG. 6 is a top plan view of an embodiment of the body 200. The internal cavity 406, including the ram passage 500, is illustrated within the walls 600 of the body 200. The illustrated embodiment includes the door openings 400 extending through the front side 202. The outlets 300 have been removed for clarity. In various embodiments, dimensions of the internal cavity 406 may be adjusted based on expected operating conditions of the BOP 116. For example, higher pressures may include thicker walls 600 and the like.

Figure 7B:
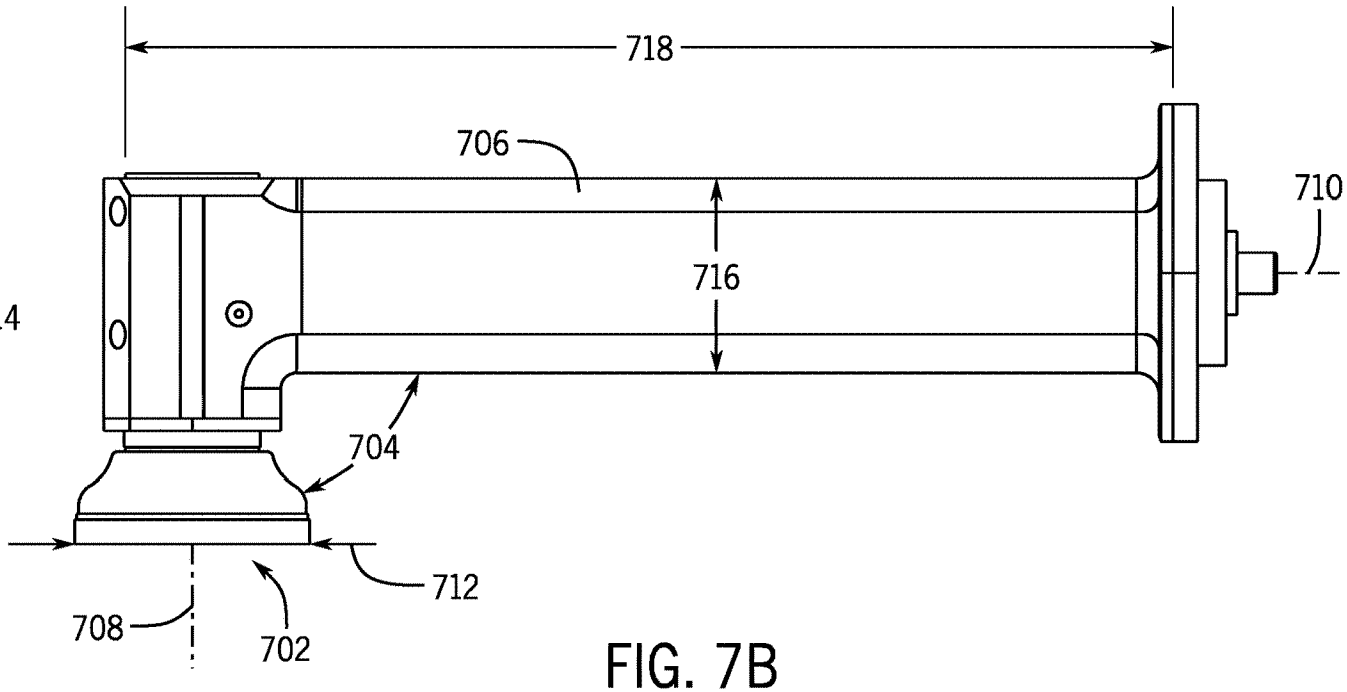
FIG. 7B is a side view of an embodiment of a cutting tool, in accordance with embodiments of the present disclosure.
Figure 7A:
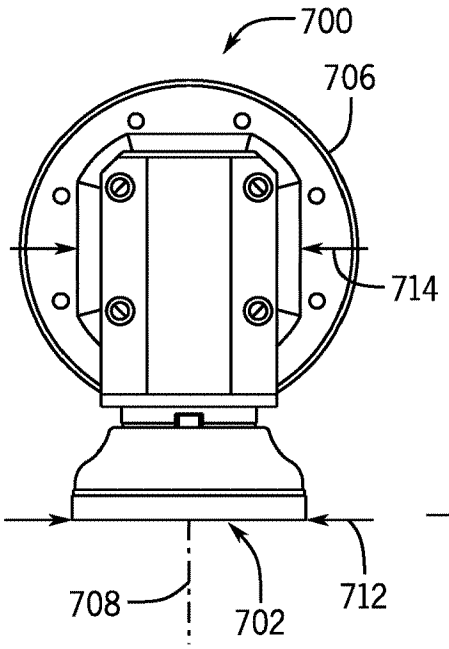
FIG. 7A is a front view of an embodiment of a cutting tool, in accordance with embodiments of the present disclosure.

FIGS. 7A and 7B include views of a cutting tool 700, which may be utilized to form at least a portion of the body 200, such as the ram passage 500 and/or the top seat 502. For example, in various embodiments, features of the body 200 may be cast and then additional segments may be formed using the cutting tool 700, as well as other tools. FIG. 7A is a front view of the cutting tool 700, including a cutting head 702. FIG. 7B is a side view of the cutting tool 700. As illustrated, the cutting head 702 may be arranged at an angle 704 with respect to a tool body 706. For example, the cutting tool 700 may be referred to as a 90-degree cutting tool because an axis 708 of the cutting head 702 is arranged at the angle 704 with respect to a tool body axis 710. In operation, a diameter 712 of the cutting head 702 may include a blade or cutting features to remove material from the body 200 in response to rotational movement about the axis 708. The diameter 712 may be adjusted, in various embodiments, to change the size of the top seat 500. For example, different cutting heads 702 may be coupled to the tool body 706.

Machining operations may include inserting the cutting tool 700 into the door openings 400 to form at least a portion of the top seat 502 within the internal cavity 406. This 90-degree cutting operation may present challenges, since typical top seat machining processes are performed substantially parallel to the opening that receives the cutting tool 700. As a result, features of the cutting tool 700 may be particularly selected to accommodate vibration, deflection, and the like. For example, a body width 714, a body height 716, and a body length 718 may be selected to absorb vibration and reduce deflection. As a result, the cutting tool 700 may be inserted into the door openings 400 and then moved along an axis of the operator opening 404 to machine the top seat 500.

Figure 8:
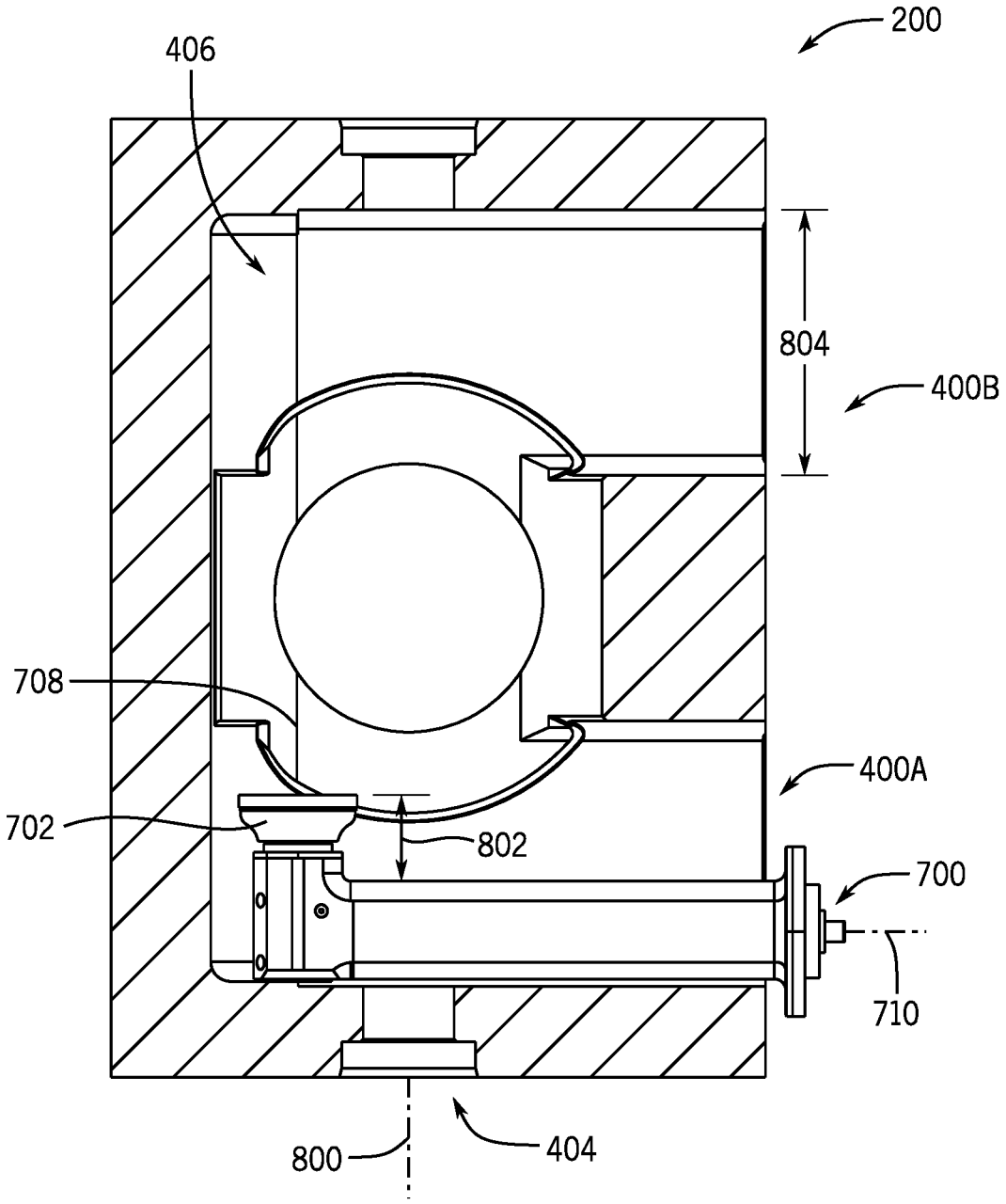
FIG. 8 is a top plan view of an embodiment of a BOP including a cutting tool extending into an internal cavity, in accordance with embodiments of the present disclosure.

FIG. 8 is a top plan view of an embodiment of the body 200 that includes the cutting tool 700 extending into the internal cavity 406 via the door opening 400. As shown, the axis 708 of the cutting head 702 is substantially parallel to an operator opening axis 800, while the tool body axis 710 is substantially perpendicular to the operator opening axis 800. The cutting tool 700 may be installed through the door opening 400 and then moved along the operator opening axis 800 to form at least a portion of the top seat 502 and/or the ram passage 500. As noted above, this machining method differs from traditional techniques in that the tool body axis 710 is substantially perpendicular to the operator opening axis 800, which generates challenges associated with the deflection and vibration of the cutting tool 700 during operation. However, embodiments of the present disclosure include particularly selected component sizes and materials to absorb vibration and/or deflections. In various embodiments, a cutting head distance 802 is sufficient to enable movement along the operator opening axis 800 for a door opening width 804 to form at least a portion of the ram passage 500 and/or the top seat 502 and then to allow the rest of the ram passage 500 and/or top seat 502 formation through the other door opening 400. In other words, a portion is formed through the first door opening 400A and a second portion through the second door opening 400B.

Figure 9:
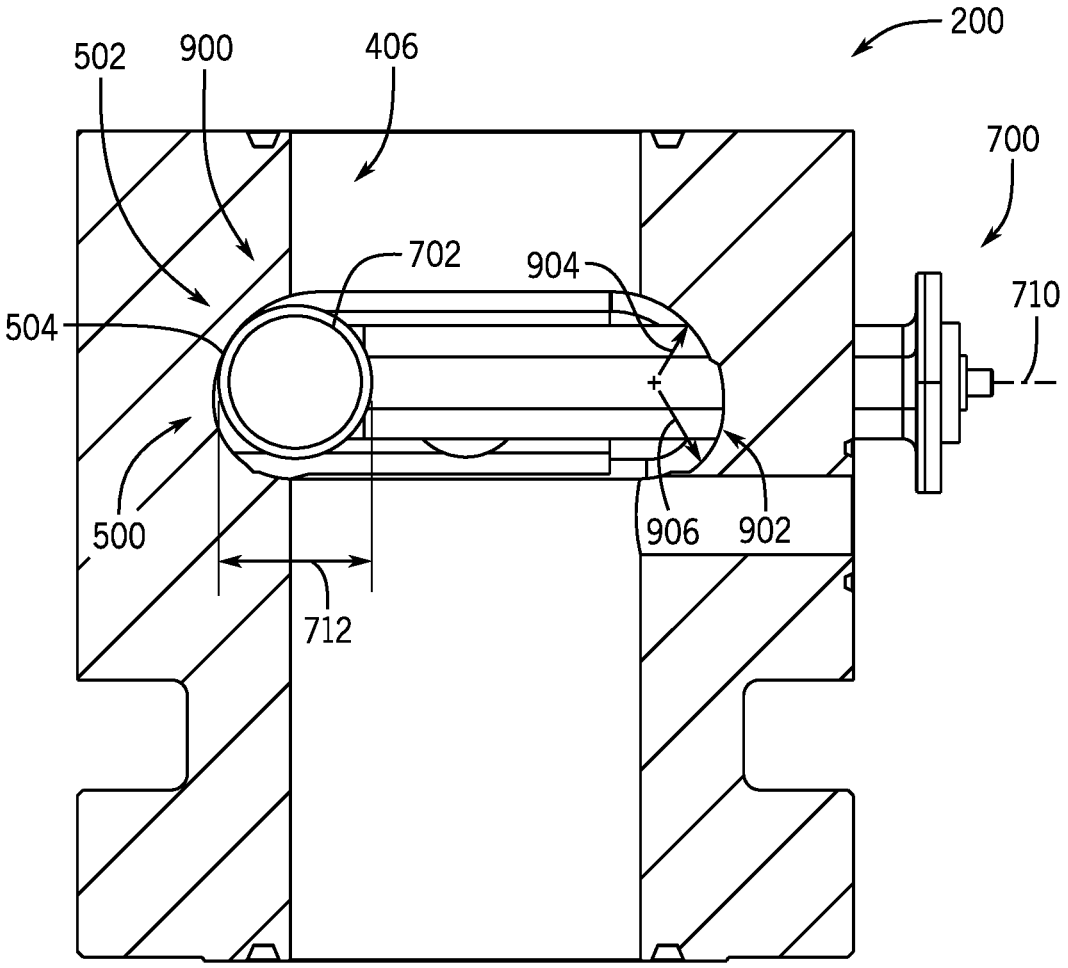
FIG. 9 is a side view of an embodiment of a BOP including a cutting tool extending into an internal cavity, in accordance with embodiments of the present disclosure.

FIG. 9 is a cross-sectional side view of an embodiment of the cutting tool 700 extending into the internal cavity 406 to form at least a portion of the ram passage 500. In the illustrated embodiment, at least a portion of the rounded edge 504 conforms to the diameter 712 of the cutting head 702, thereby facilitating formation of the top seat 502. It should be appreciated that, in various embodiments, the ram passage 500 may include a top portion 900 and a bottom portion 902, which may each have a different top radial distance 904 and bottom radial distance 906. However, in other embodiments, the top portion 900 may be substantially equal to the bottom portion 902. Furthermore, in embodiments, a portion may be cast with the other portion may be machined. Accordingly, it should be appreciated that the machining and/or casting method may be particularly selected to minimize machining operations and to reduce costs. In operation, the cutting tool 700 moves along the operator opening axis 800 to from at least a portion of the rounded edge 504 of the top seat 502.

Figure 10:
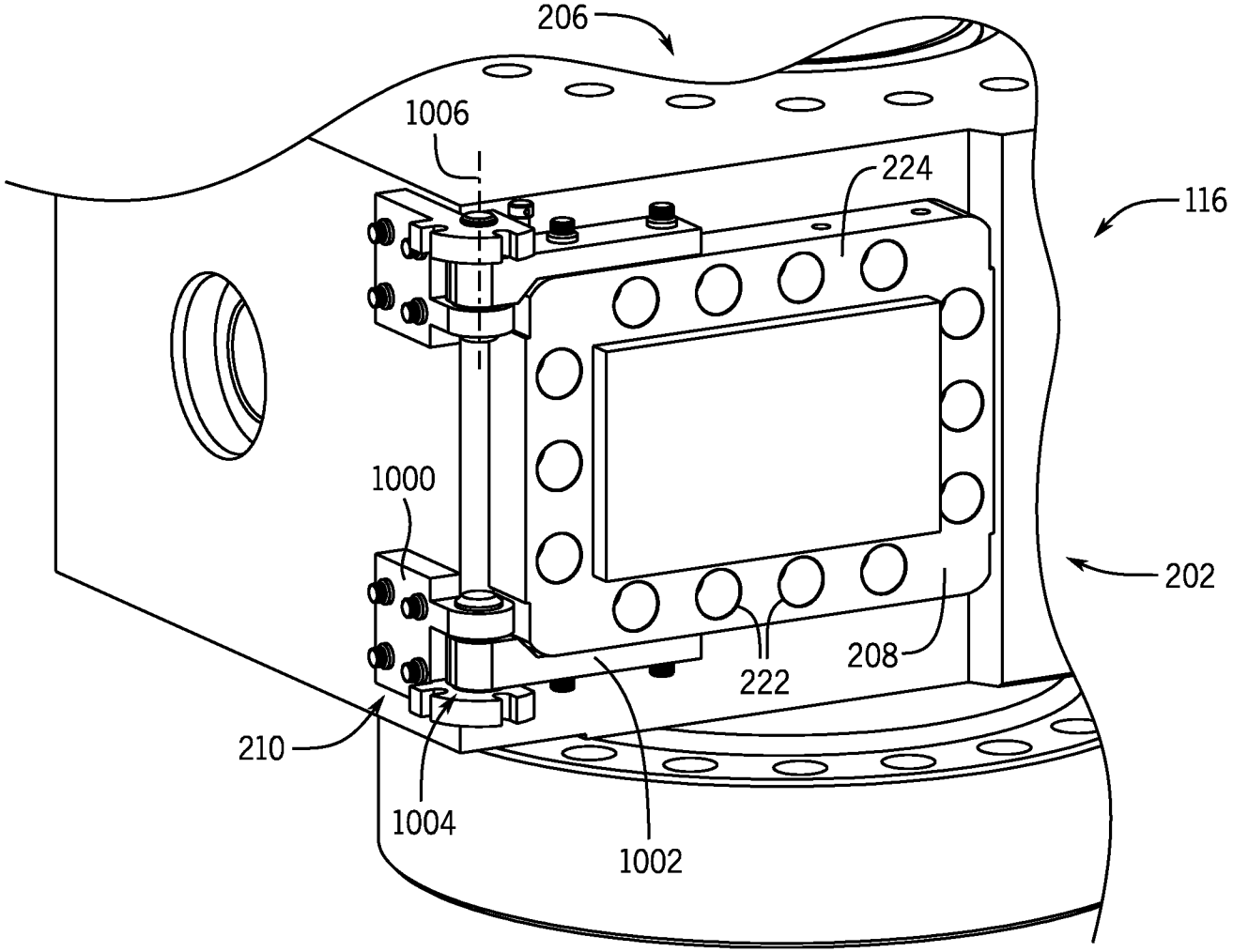
FIG. 10 is a perspective view of an embodiment of a door assembly in a closed position, in accordance with embodiments of the present disclosure.
Figure 11:
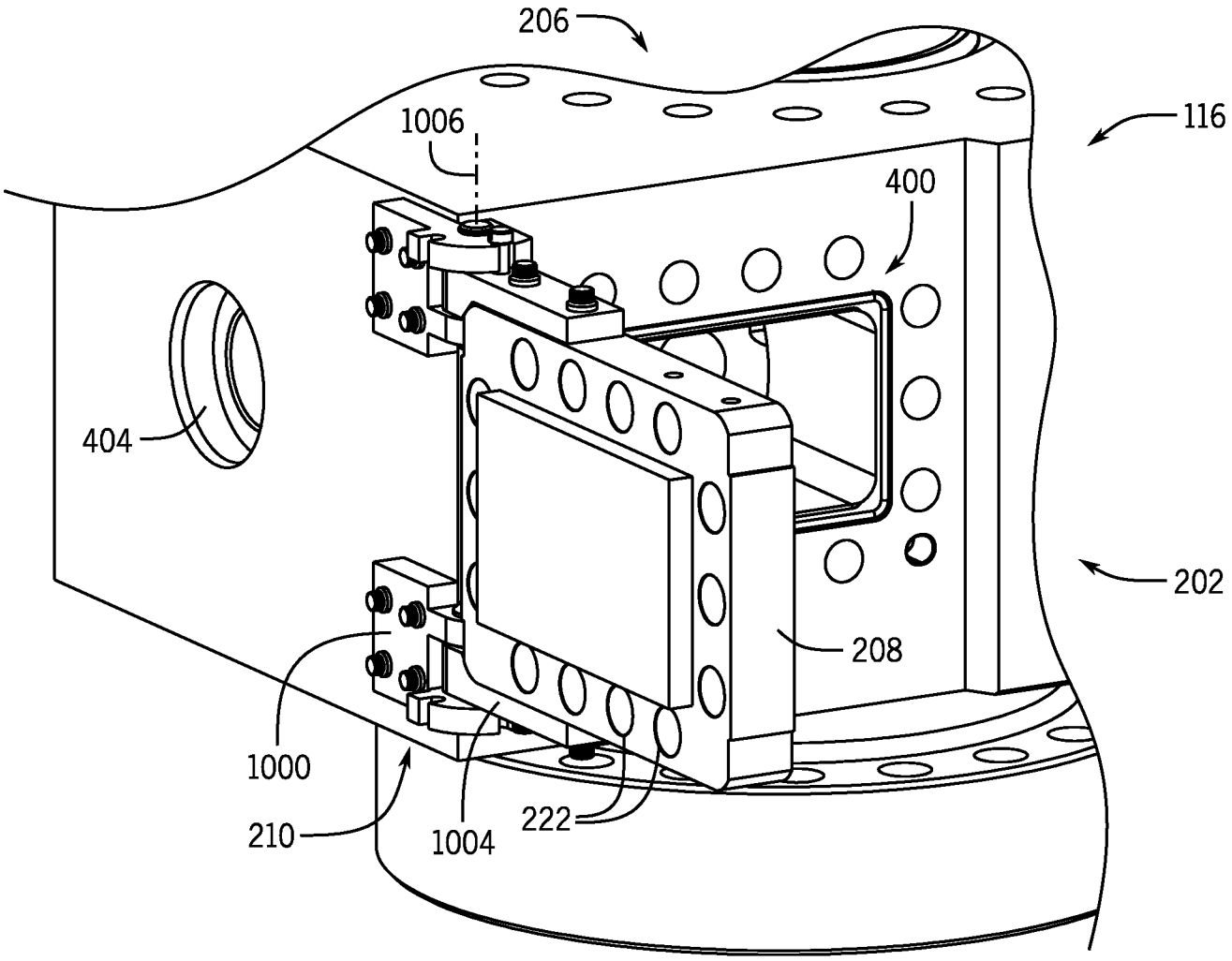
FIG. 11 is a perspective view of an embodiment of a door assembly in an open position, in accordance with embodiments of the present disclosure.

FIG. 10 is a perspective view of an embodiment of the BOP 116 including the door assembly 206 arranged on the front side 202. In the illustrated embodiment, the door assembly 206 includes the door 208 and the hinges 210, which allow the door 208 to move between the illustrated closed position and an open position (FIG. 11). The illustrated door 208 is arranged substantially flush on the front side 202, thereby forming a seal at the door opening 400. In various embodiments, the apertures 222 on the door face 224 enable fasteners to couple the door 208 to the front side 202. As noted above, it should be appreciated that there may be a different number of apertures 222 and they may be arranged in different locations on the face 224. Furthermore, in embodiments, a different locking mechanism, such as a latch with a pad lock or the like, may be utilized in place of or in addition to the apertures 222.

In operation, the hinges 210 support the door 208 and may be particularly selected to receive the weight of the door 208, and in embodiments, other components such as the rams that may apply forces to the door 208, as will be described in detail below. The hinges 210 include a hinge body 1000 and a hinge coupling 1002. The hinge body 1000 is coupled to the hinge coupling 1002 at an interface 1004, which may include a rotational axis 1006 for the door 208. In various embodiments, a pin or the like may be arranged at the interface 1004 to enable the door to rotate bout the axis 1006. In various embodiments, the hinge coupling 1002 is secured to the door 208, for example, via couplings or the like. The hinge body 1000 may also be secured to the body 200 via couplings or the like, which have been removed in the illustrated embodiment for clarity.

FIG. 11 is a perspective view of the door 208 arranged in the open position. As opposed to the view of FIG. 10, the door 208 in FIG. 11 has been rotated about the rotational axis 1006 to move the door 208 away from the front side 202 of the body 200. For example, the fasteners may be removed from the apertures 222 to enable the door 208 to move away from the 200. As noted above, the hinges 210 support the weight of the door 208 and any associated components. For example, in the illustrated embodiment, hinge bodies 1000 and hinge couplings 1002 are arranged at both a top and bottom of the door 208. It should be appreciated that while the illustrated open position arranges the door 208 at substantially a 90 degree angle with the front side 202, in other embodiments the angle may be greater or less than 90 degrees.

Figure 12:
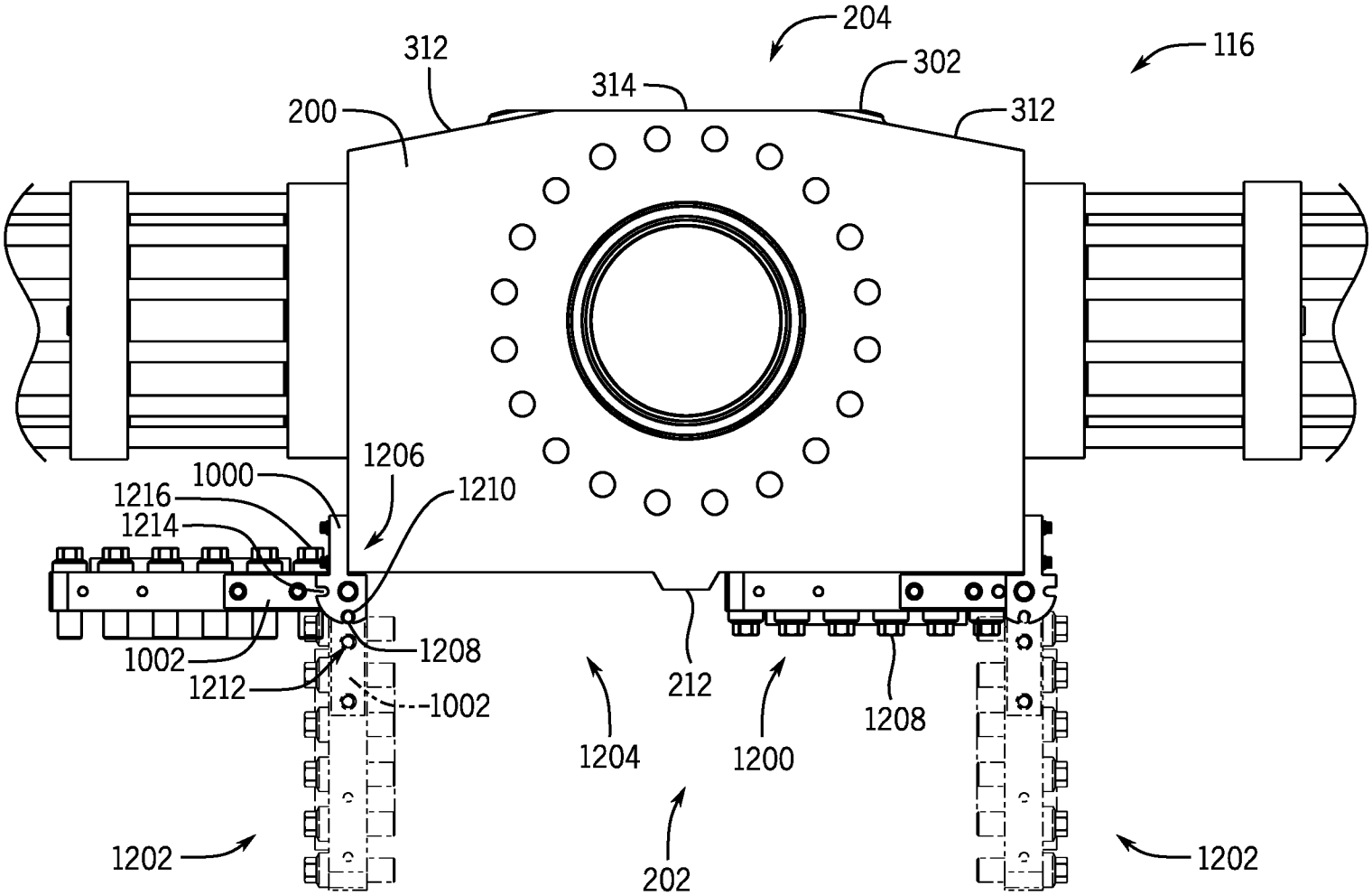
FIG. 12 is a top plan view of an embodiment of a BOP including door assemblies arranged in an open position, a closed position, and a maintenance position, in accordance with embodiments of the present disclosure.

FIG. 12 is a top plan view of an embodiment of the BOP 116 illustrating the door assemblies 206 having the doors 208 in a closed position 1200, an open position 1202 (phantom lines), and a maintenance position 1204. In various embodiments, a rotation mechanism 1206 may be utilized to facilitate rotation of the doors 208 and/or to maintain the doors 208 in a particular position.

The illustrated embodiment includes the front side 202 with the rib 212 positioned between the door assemblies 206. On the opposite side, the back side 204 is positioned with the platforms 302. In various embodiments, the movement of the doors 208 may provide a stress to the body 200. However, as described above, various features of the BOP 116, such as the rib 212, first portion 312, second portion 314, or the like may be utilized to reduce stresses to enable operation of the BOP 116.

In the illustrated embodiment, the door 208 is arranged in the closed position 1200, and as a result, the door 208 is positioned against the front side 202. The illustrated embodiment includes fasteners 1208 to secure the door 208 to the front side 202. In the illustrated embodiment, the door 208 is arranged proximate the rib 212 when in the closed position 1200. Further illustrated is movement of the door 208 to the open position 1202. In the illustrated embodiment, the door 208 extends away from the front side 202 such that the hinge coupling 1002 is substantially perpendicular to the front side 202. In various embodiments, the hinge 210 enables rotation of the door 208 about the axis 1006 to transition between the closed position 1200 and the open position. Further illustrated is the maintenance position 1204, where the door 208 is substantially clear of the front side 202 to provide access the front side 202 and/or the internal cavity 406. In the illustrated maintenance position 1204, the hinge coupling 1002 is substantially parallel to the front side 202, much like in the closed position 1200. However, as shown, the door 208 transitions away from the front side 202 such that the door 2008 is substantially 180 degrees away from the front side 202.

In various embodiments, the hinge 210 includes the rotation mechanism 1206, which may limit rotation of the door 208 and/or maintain a desired position of the door 208. The rotation mechanism 1206 is illustrated with a body region 1208, which is substantially curved. The body region 1208 includes an opening 1210 at a first end 1212 and an opening 1214 at a second end 1216. The openings 1210, 1214 may receive a pin, which locks the door 208 in position. In the illustrated embodiment, the pin may extend through the opening 1210, when the door 208 is in the open position 1202, to secure the door 208 in the open position. Similarly, the pin may extend through opening 1214 when the door is in the maintenance position 1204 to secure the door 208 in the maintenance position. That is, as the door 208 rotates from the closed position 1200 to the open position 1202, an opening in the hinge coupling 1002 may align with the opening 1210 to receive the pin. In this manner, the door 208 may be secured at various different locations, which may simplify operations because operators may not be worried about moving the door 208 between different positions.

Figure 13:
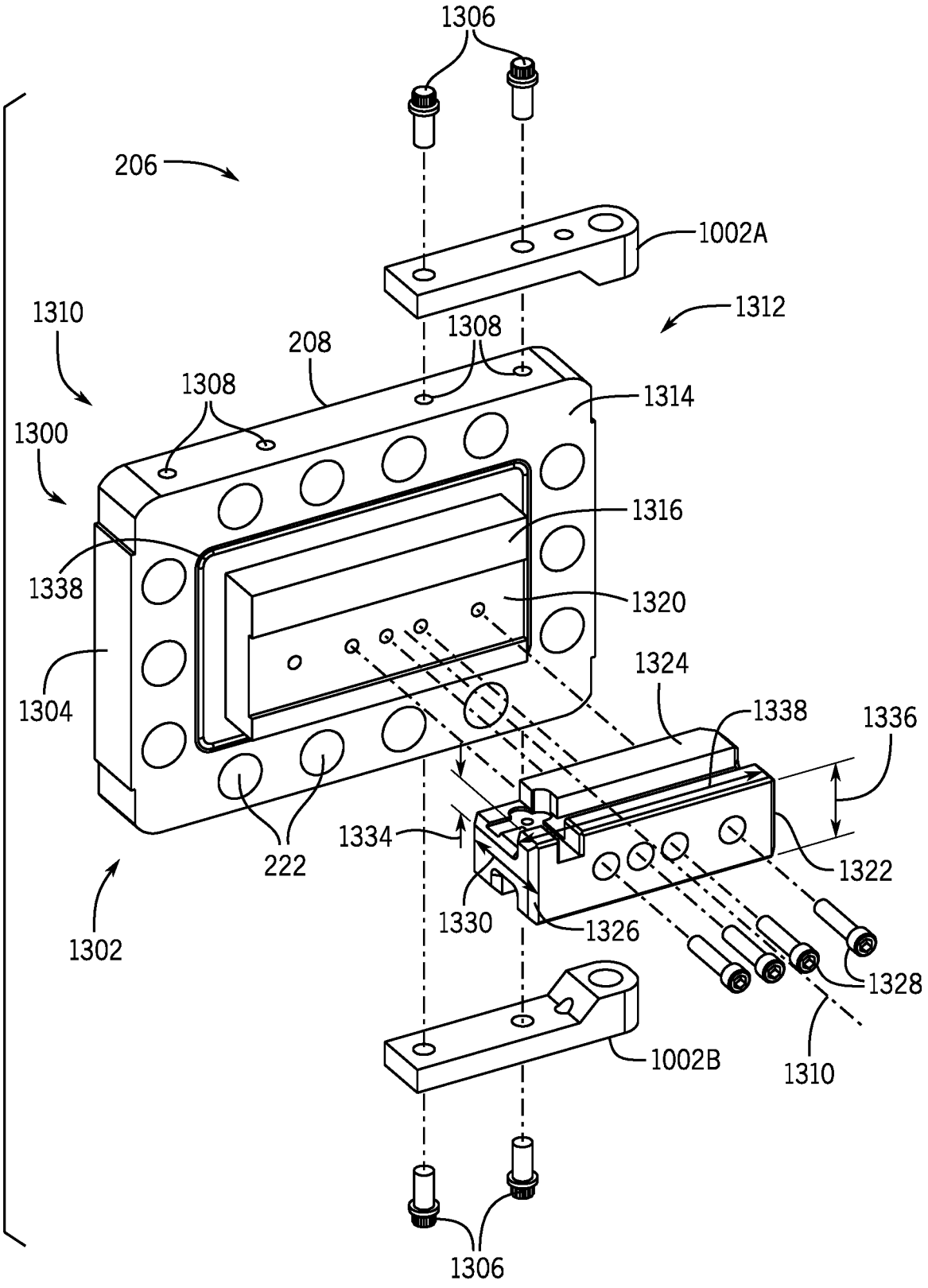
FIG. 13 is an exploded view of an embodiment of a door, in accordance with embodiments of the present disclosure.

FIG. 13 is an exploded perspective view of an embodiment of a portion of the door assembly 206, including the door 208 and the hinge coupling 1002. In the illustrated embodiment, the hinge coupling 1002A is arranged at a top 1300 of the door 208 and the hinge coupling 1002B is arranged at a bottom 1302 of the door 208. As a result, forces may be translated from the door to the hinge coupling 1002, which may further translate the forces to the hinge 210 and the body 200. The illustrated hinge couplings 1002 are coupled to the door 208 along an outer perimeter 1304 via fasteners 1306. The illustrated door 208 includes receptacles 1308 to receive the fasteners 1306. In the illustrated embodiment, the receptacles 1308 are arranged to enable modularity of the door 208. In other words, the receptacles 1308 are arranged to receive the hinge coupling 1002 at either a first side 1310 or a second side 1312. In this manner, fewer different parts may be utilized for the BOP 116.

The illustrated embodiment includes the apertures 222 extending through the door 208. An inner face 1314 includes an extension 1316 that extends along a door axis 1318 away from the inner face 1314. The illustrated extension 1316 may provide further structural rigidity, for example, due to the ram extending from the door 208. It should be appreciated that an area of the extension 1316 may be particularly selected based on dimensions of the door 208, among other factors. The extension 1316 includes a recess 1320 that receives a T-bar 1322. For example, a bottom end 1324 of the T-bar 1322, opposite the top end 1326, may be positioned within the recess 1320. The T-bar 1322 may be coupled to the extension 1316 via fasteners 1328. As a result, the door 208 may further include the T-bar 1322 on the inner face 1314.

In various embodiments, the T-bar 1322 extends a bar length 1330 along the door axis 1318. The T-bar 1322 also includes a bar width 1332 and a first bar height 1334 and a second bar height 1336. In the illustrated embodiment, the second bar height 1336 is greater than the first bar height 1334. In operation, the T-bar 1322 may be utilized to receive or position the rams prior to installation within the inner cavity 406.

The embodiment of the door 208 further includes a seal groove 1338 arranged about the extension 1316. In the illustrated embodiments, the apertures 222 are arranged between the seal groove 1338 and the edges of the door 208. The position of the seal groove 1338 may be particularly selected based on a size of the apertures 222 and/or the extension 1316. The location of the seal groove 1338 provides a sufficient squeeze of a seal while also being positioned independent of and out of the way of the apertures 222.

Figure 14:
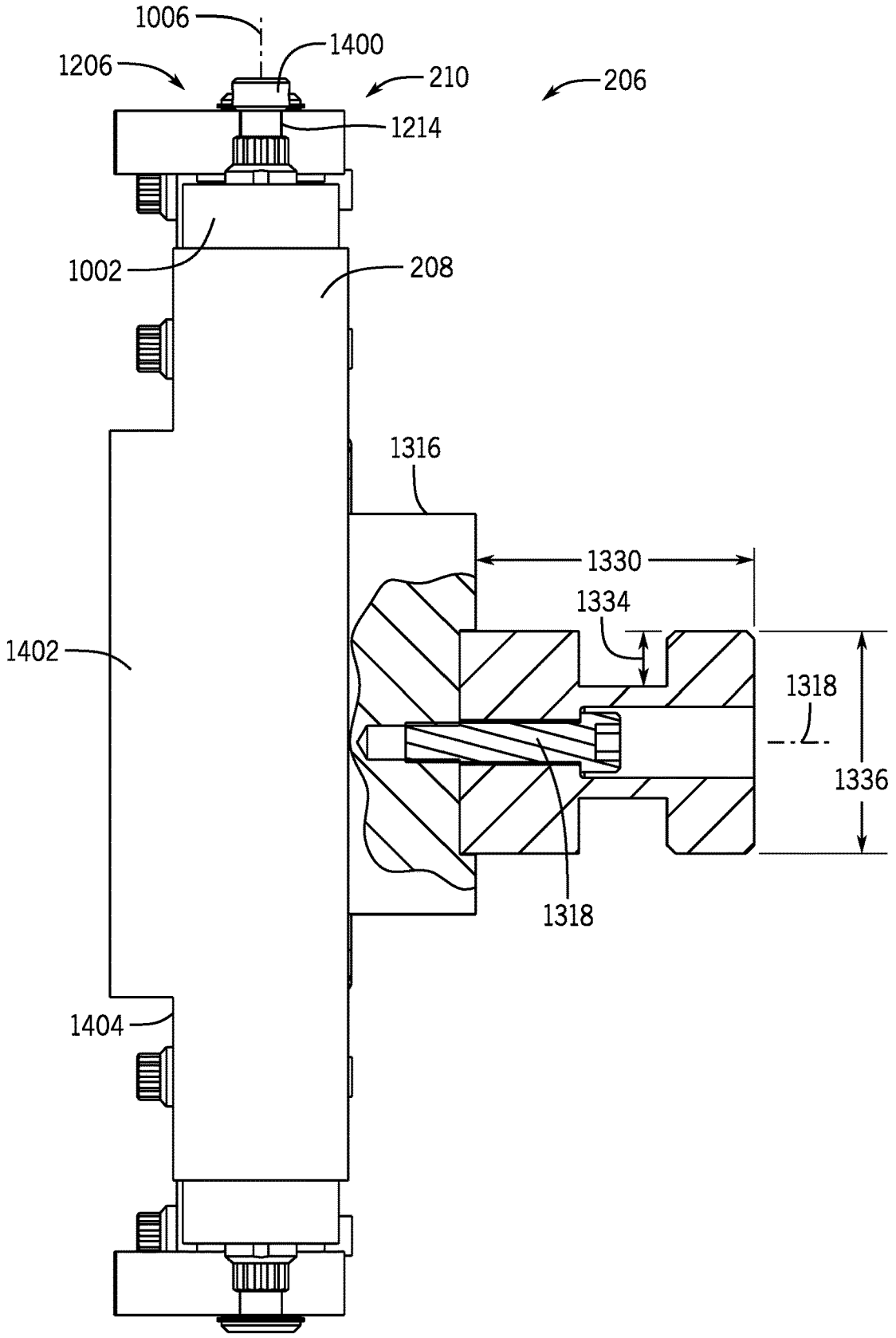
FIG. 14 is a side view of an embodiment of a door, in accordance with embodiments of the present disclosure.

FIG. 14 is a side view of an embodiment of the door assembly 206 including the door 208. The illustrated door 208 is coupled to the hinges 210, for example via the hinge coupling 1002. The door 208 is arranged to rotate about the axis 1006. In various embodiments, rotation is at least partially regulated by the rotation mechanism 1206, which may include a first opening 1214 that receives a pin 1400 to lock the door 208 into position.

The illustrated door 208 includes a stiffener 1402 on an exterior face 1404. In the illustrated embodiment, the stiffener 1402 extends laterally away from the exterior face 1404 along the door axis 1318. Further illustrated is the T-bar 1322 coupled to the extension 1316 via the fastener 1328. As illustrated, the T-bar 1322 includes the bar length 1330 and the first bar height 1334 and the second bar height 1336. As will be described, the T-bar 1322 may be utilized to position and retrieve the block from the internal cavity 406.

Figure 15:
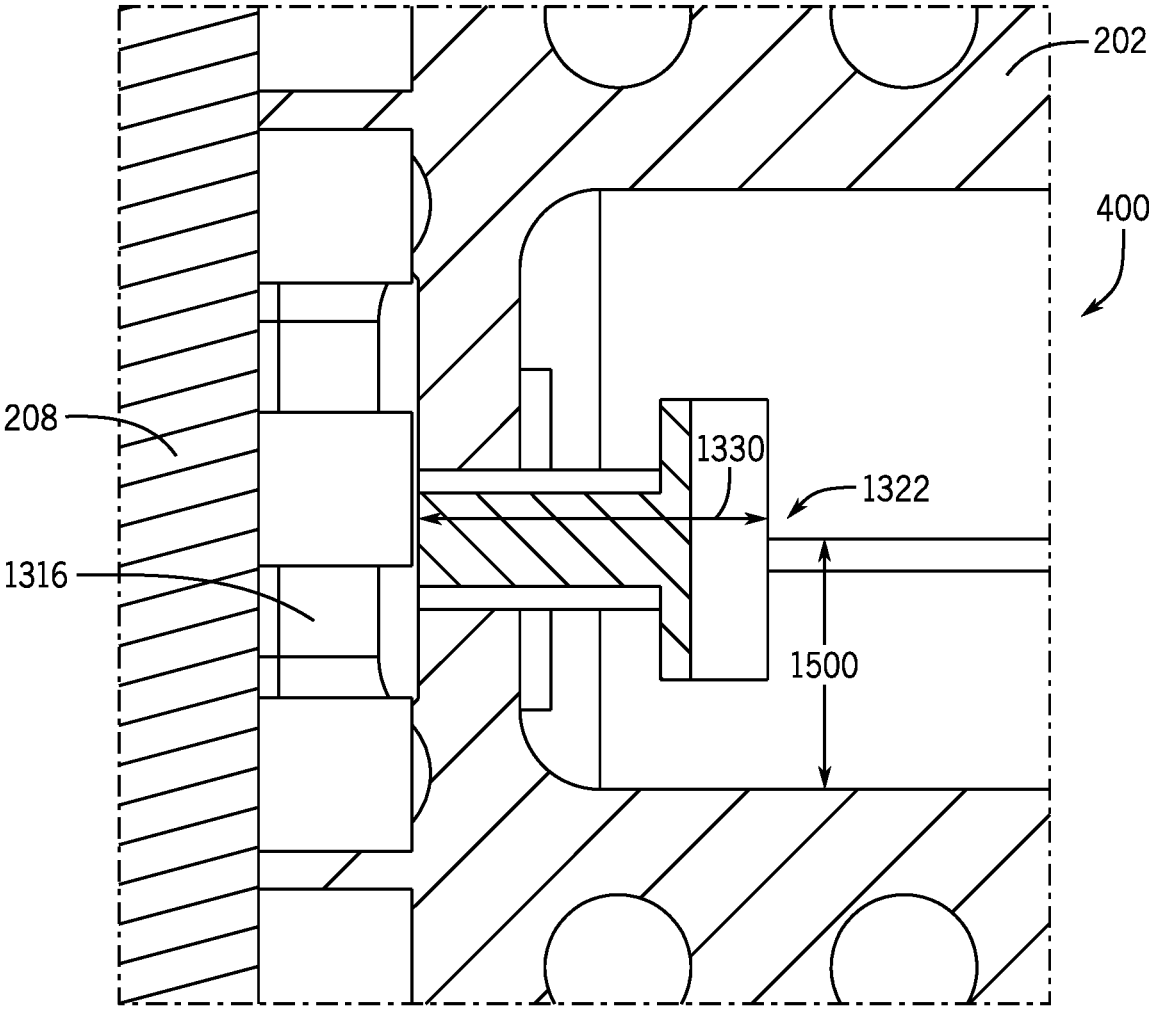
FIG. 15 is a side view of an embodiment of a door arranged proximate a BOP body opening, in accordance with embodiments of the present disclosure.

FIG. 15 is a side view of an embodiment of the T-bar 1322 arranged proximate the door opening 400. The T-bar 1322 is coupled to the extension 1316 of the door 208. As illustrated, the bar length 1330 enables at least a portion of the T-bar 1322 to extend beyond the door opening 400 when the door 208 is in the open position. In various embodiments, the T-bar 1322 is substantially aligned with a piston associated with the operator 234. That is, a height from the door opening 1500 may be substantially equal between the T-bar 1322 and the piston.

Figure 16:
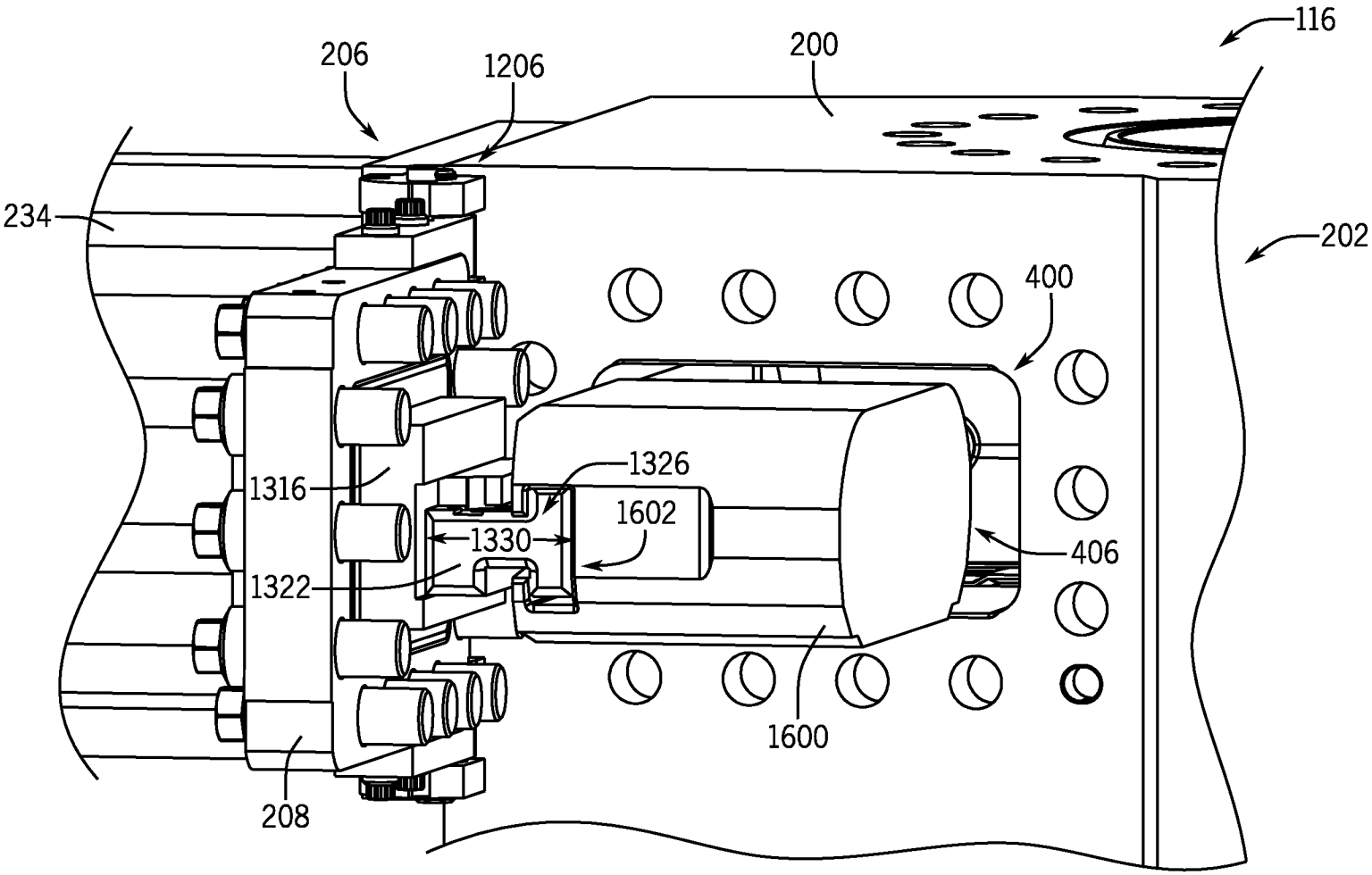
FIGS. 16-18 are perspective views of an embodiment of a loading procedure to position a block within an internal cavity of a BOP, in accordance with embodiments of the present disclosure.

FIG. 16 is a side view of an embodiment of a ram block 1600 positioned on the T-bar 1322 proximate the door opening 400. In the illustrated embodiment, the ram block 1600 includes a slot 1602 that receives the top end 1326 of the T-bar 1322. As a result, weight from the ram block 1600 may be distributed to the door 208. Accordingly, it may be easier to install the ram block 1600 without additional equipment, such as a crane. Installation is therefore cheaper and easier for operations personnel. In various embodiments, a tool or the like may engage either the slot 1602 or other feature on the ram block 1600 in order to facilitate installation and removal. As shown, the T-bar 1322 substantially aligns the ram block 1600 with the door opening 400 to enable movement of the ram block 1600 into the internal cavity 406.

Figure 17:
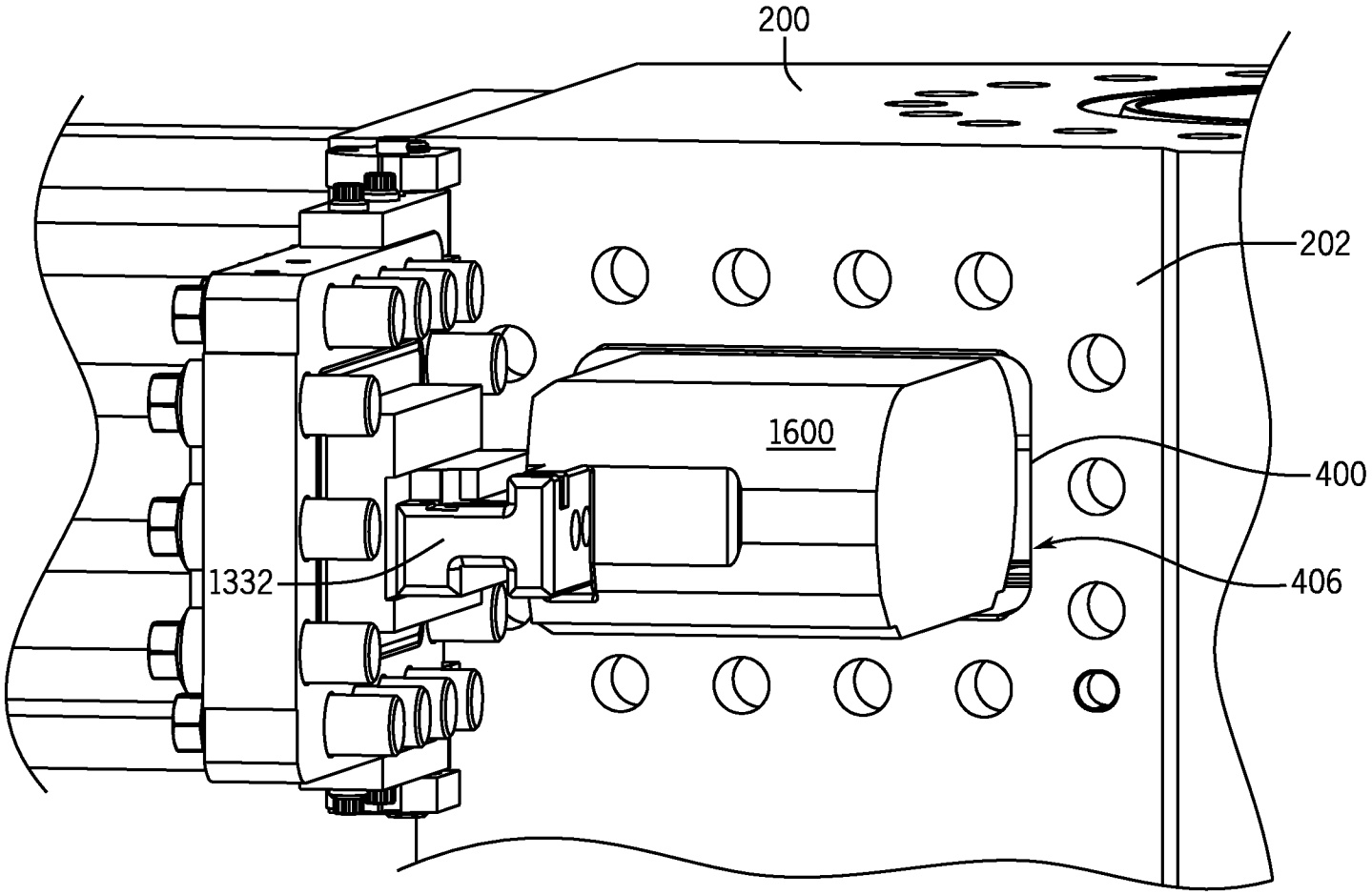

FIG. 17 is a side view of an embodiment of the ram block 1600 arranged within the internal cavity 406 of the body 200. In the illustrated embodiment, the ram block 1600 is transitioned along the T-bar 1322 and is deposited into the internal cavity 406, for example at an end of a piston associated with the operator 234. For example, the ram block 1600 may be driven into the internal cavity 406 using the T-bar 1322 as a guide and/or support, thereby reducing the force utilized to install the ram block 1600. Moreover, in various embodiments, additional tools and the like may be utilized for installation of the ram block 1600.

Figure 18:
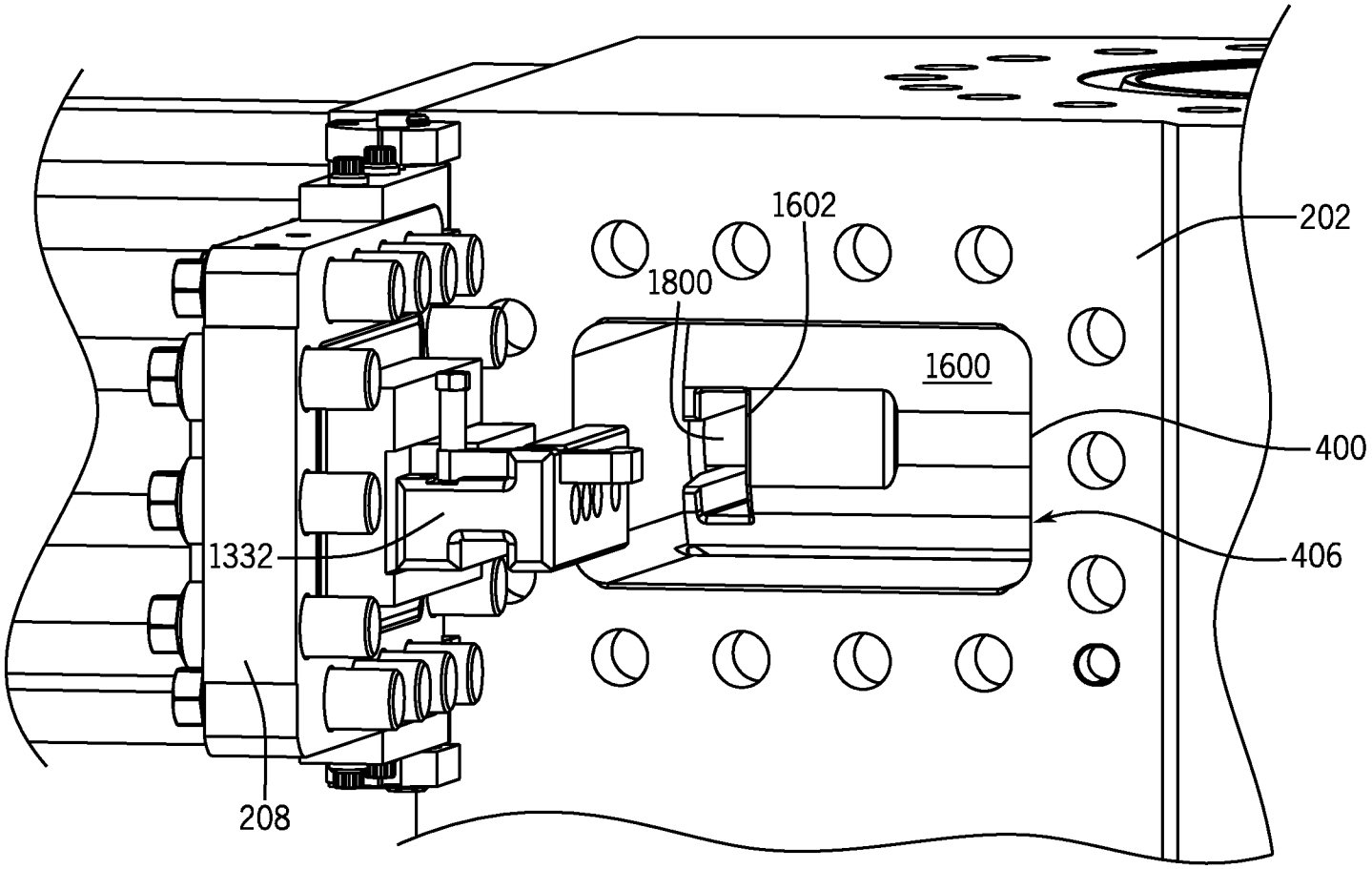

FIG. 18 is a side view of an embodiment of the ram block 1600 full installed within the internal cavity and coupled to a piston 1800. As shown, there is no longer a connection between the T-bar 1322 and the slot 1602, compared to FIGS. 16 and 17. As a result, the ram block 1600 may be supported by the piston 1800, which may also align with the slot 1602. Accordingly, in various embodiments, the piston 1800 may be utilized to drive axial movement of the ram block 1600 within the ram passage 500.

Figure 19:
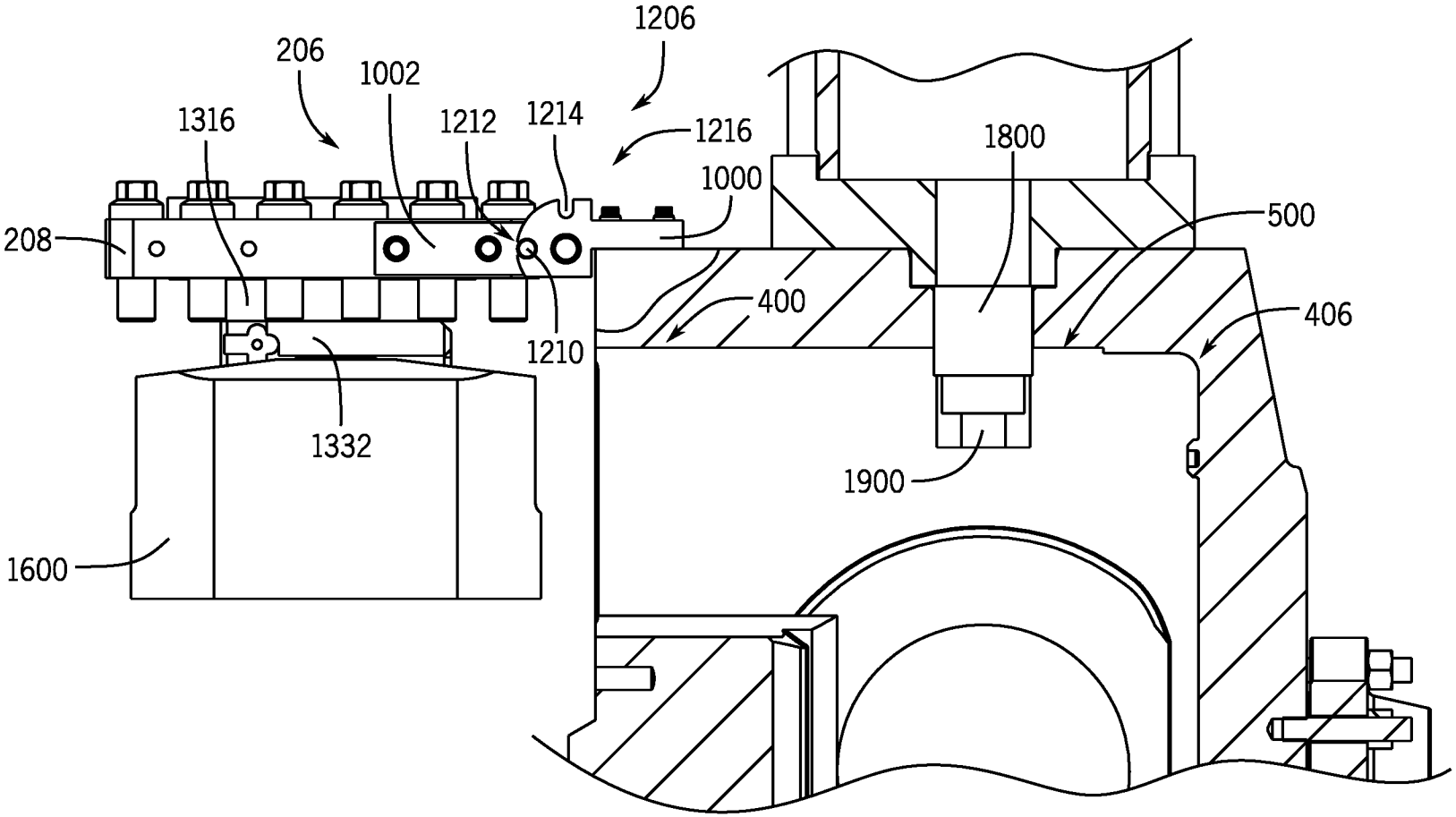
FIGS. 19-22 are top plan views of an embodiment of a loading procedure to position a block within an internal cavity of a BOP, in accordance with embodiments of the present disclosure.
Figure 20:
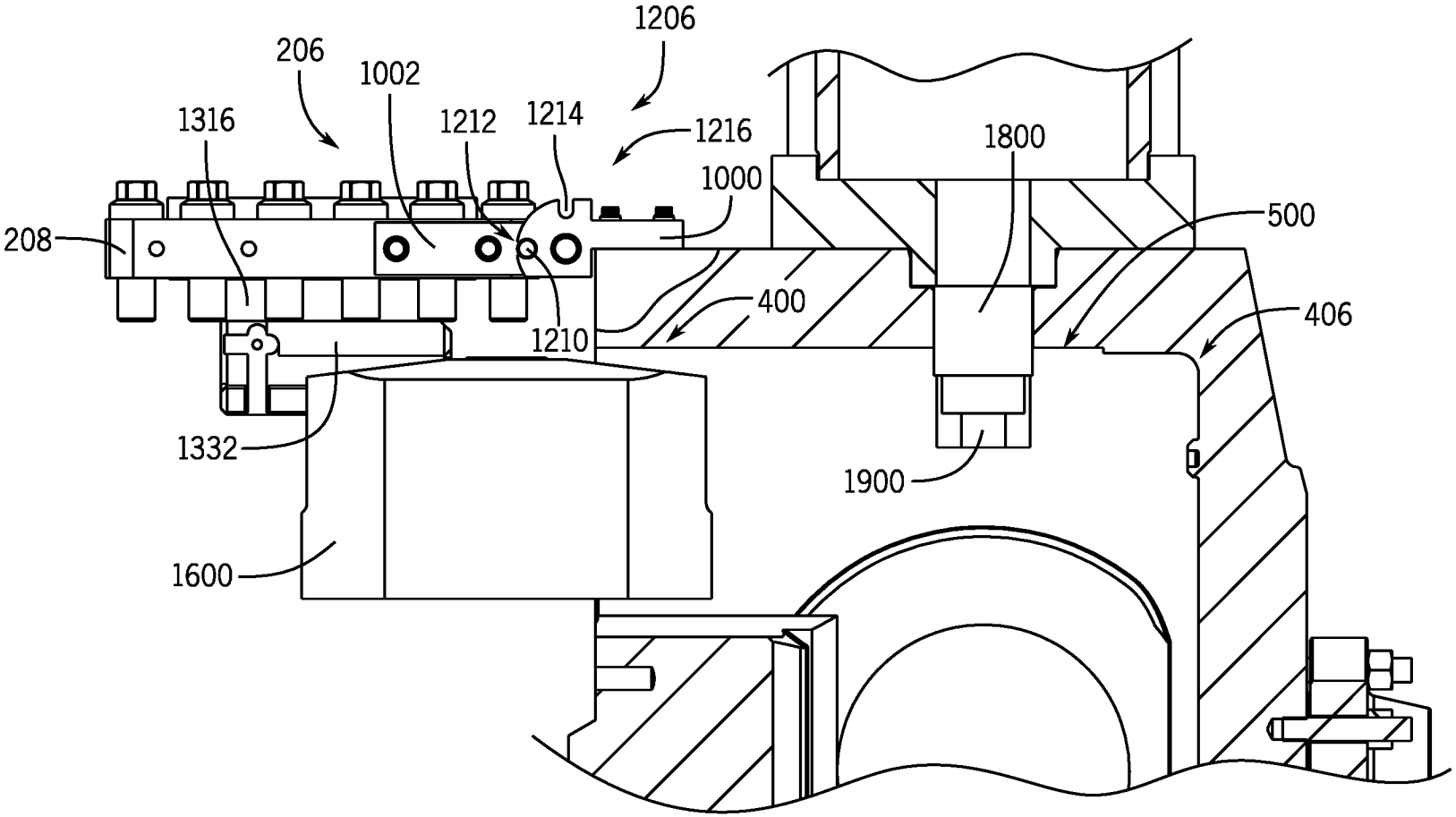

FIGS. 19-22 are top views of an installation process of the ram block 1600 utilizing the door 208 as a support for the installation. In the illustrated embodiment, the ram block 1600 is transitioned into the internal cavity 406 using the door 208 as a support, specifically, the T-bar 1322 is utilized to guide the ram block 1600 into the internal cavity 406 and into contact with a head 1900 of the piston 1800. The embodiment of FIG. 19 illustrates the ram block 1600 outside of the internal cavity 406 and supported by the door 208. In the illustrated embodiment, the T-bar 1322 is positioned within the slot 1602. FIG. 20 illustrates the ram block 1600 being slid toward the internal cavity 406 via the door opening 400. The ram block 1600 continues to be supported by the door 208, and in certain embodiments, at least a portion of the force from the weight of the ram block 1600 may be transferred the body 200. That is, the ram block 1600 may contact the body 200 and be supported by both the door 208 and the body 200.

Figure 21:
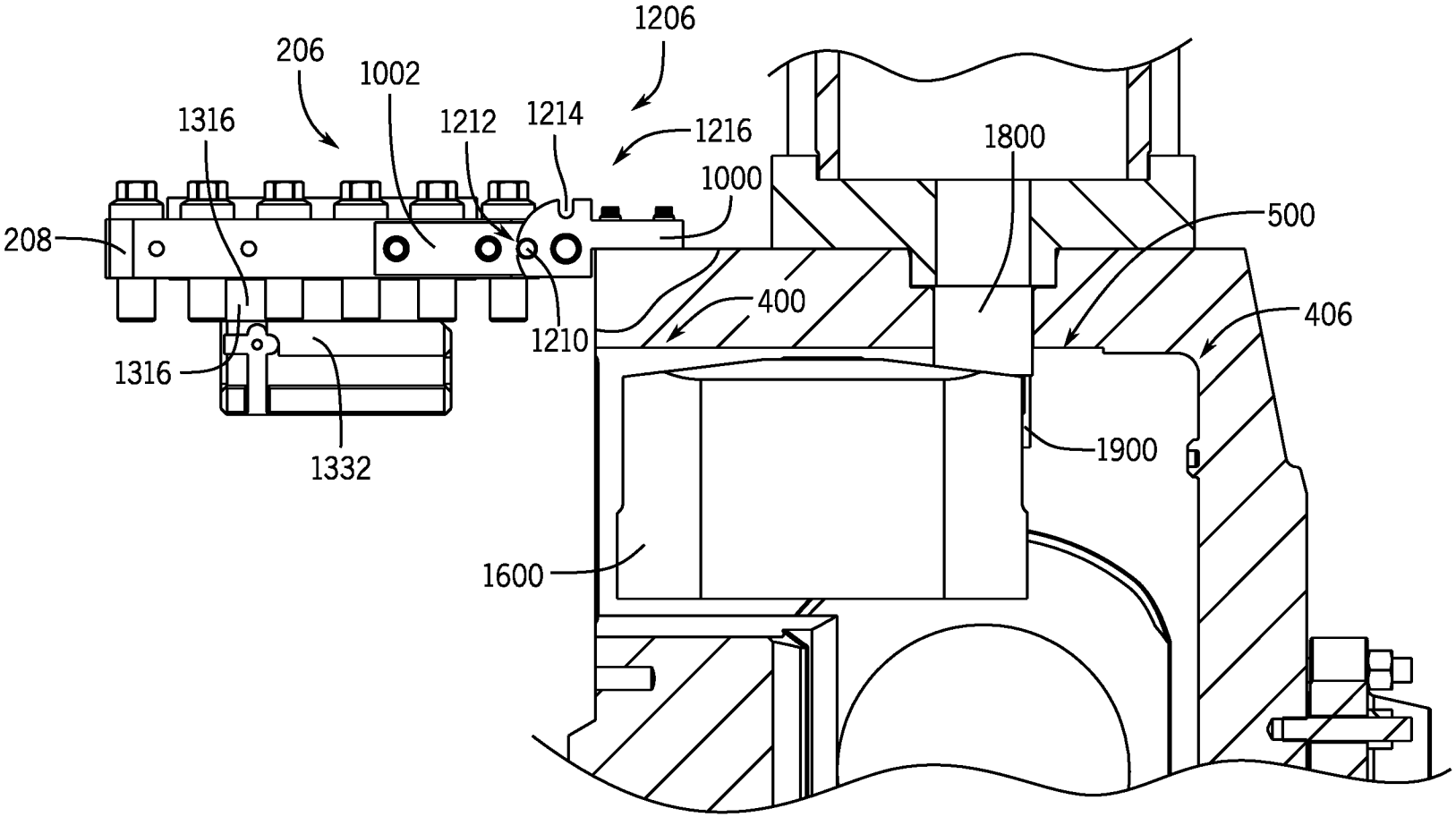
Figure 22:
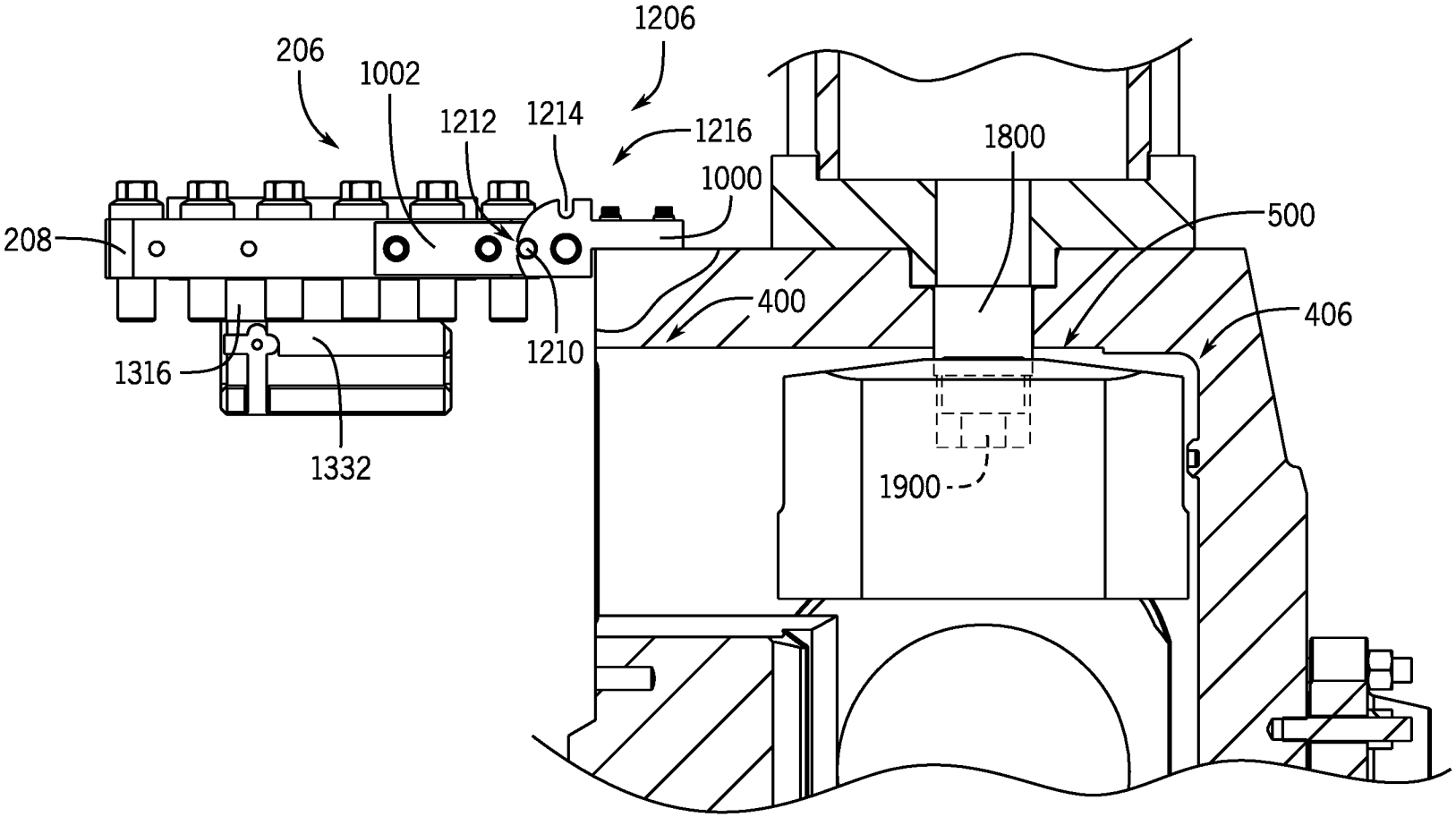

FIG. 21 illustrates the ram block 1600 arranged within the internal cavity 406 and no longer coupled to the door 208. The ram block 1600 engages the piston head 1900, for example, via the slot 1602. The ram block 1600 may be supported by the body 200. FIG. 22 illustrates the ram block 1600 arranged within the ram passage 500. The ram block 1600 is arranged on the piston 1800 via the piston head 1900. In embodiments, one or more tools or fasteners may be utilized to couple the ram block 1600 to the piston head to maintain alignment. However, in other embodiments, the arrangement within the slot 1602 and weight of the ram block 1600 may be sufficient to keep the ram block 1600 in position.

Figure 23:
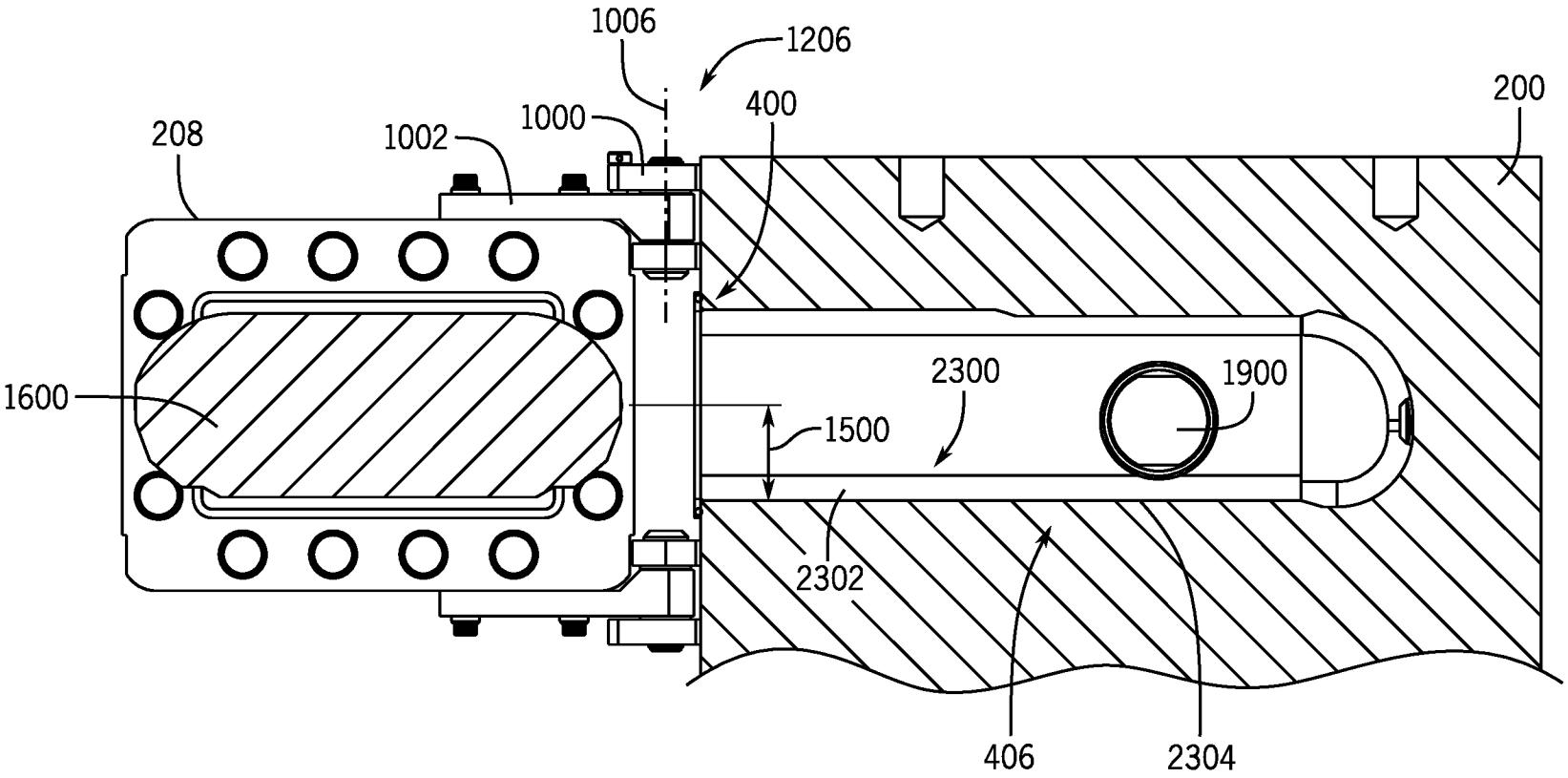
FIGS. 23-27 are side views of an embodiment of a loading procedure to position a block within an internal cavity of a BOP, in accordance with embodiments of the present disclosure.

FIGS. 23-27 illustrate side views of the installation of the ram block 1600. As described above, in various embodiments, the ram block 1600 may be translated from a position outside of the body to the ram passage 500. FIG. 23 illustrates the ram block 1600 arranged on the T-bar 1322 and supported by the door 208. As noted above, the height 1500 of the T-bar 1322 may be substantially aligned with the piston 1800 to facilitate installation of the ram block 1600. However, in other embodiments, a stepped entry 2300 may be formed, wherein a first location 2302 is at a different elevation than a second location 2304. The second location 2304 may correspond to the ram passage 500, at least in part, and facilitate installation by providing reduced friction forces as the ram block 1600 is coupled to the piston head 1900.

Figure 24:
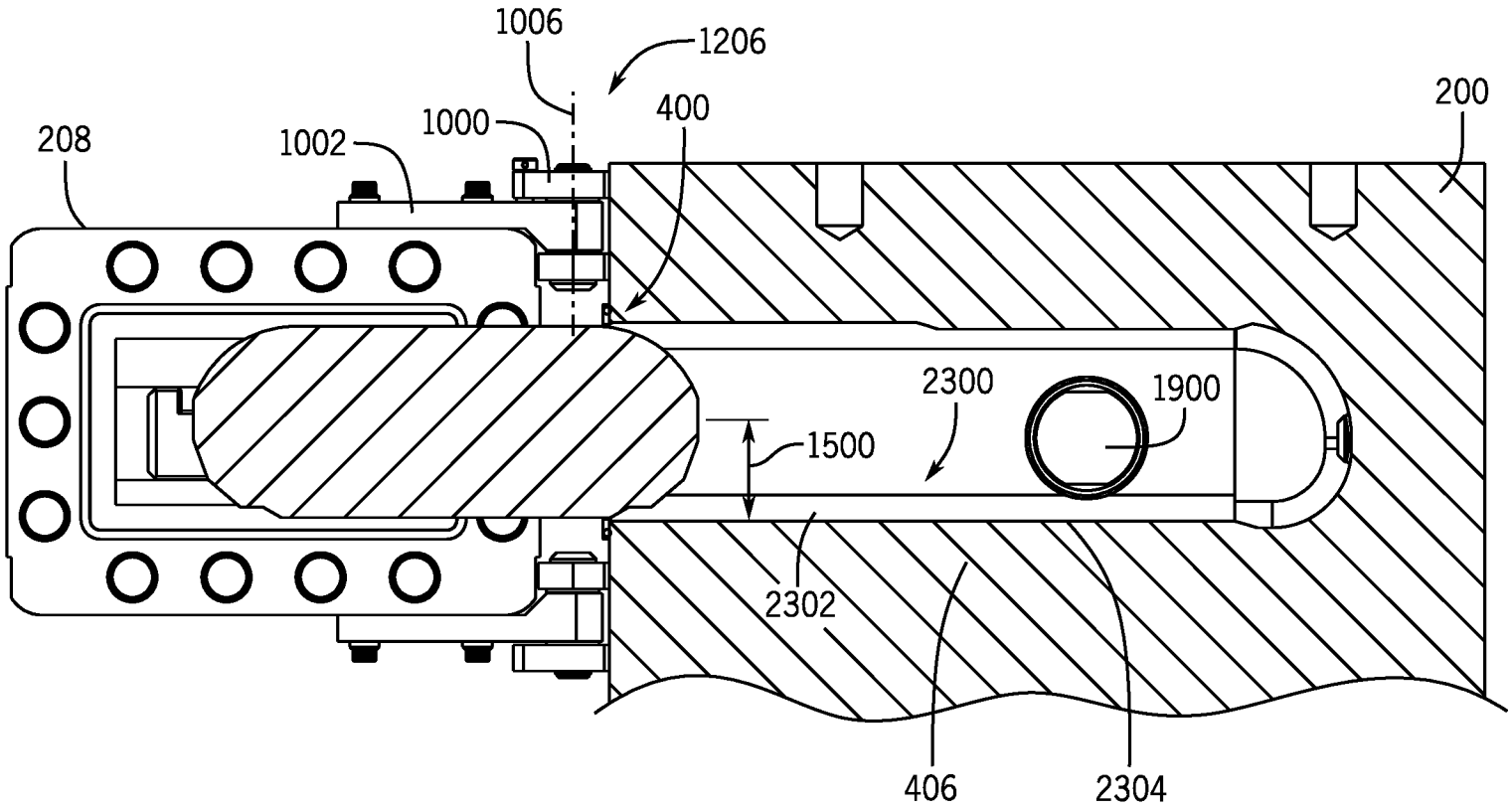
Figure 25:
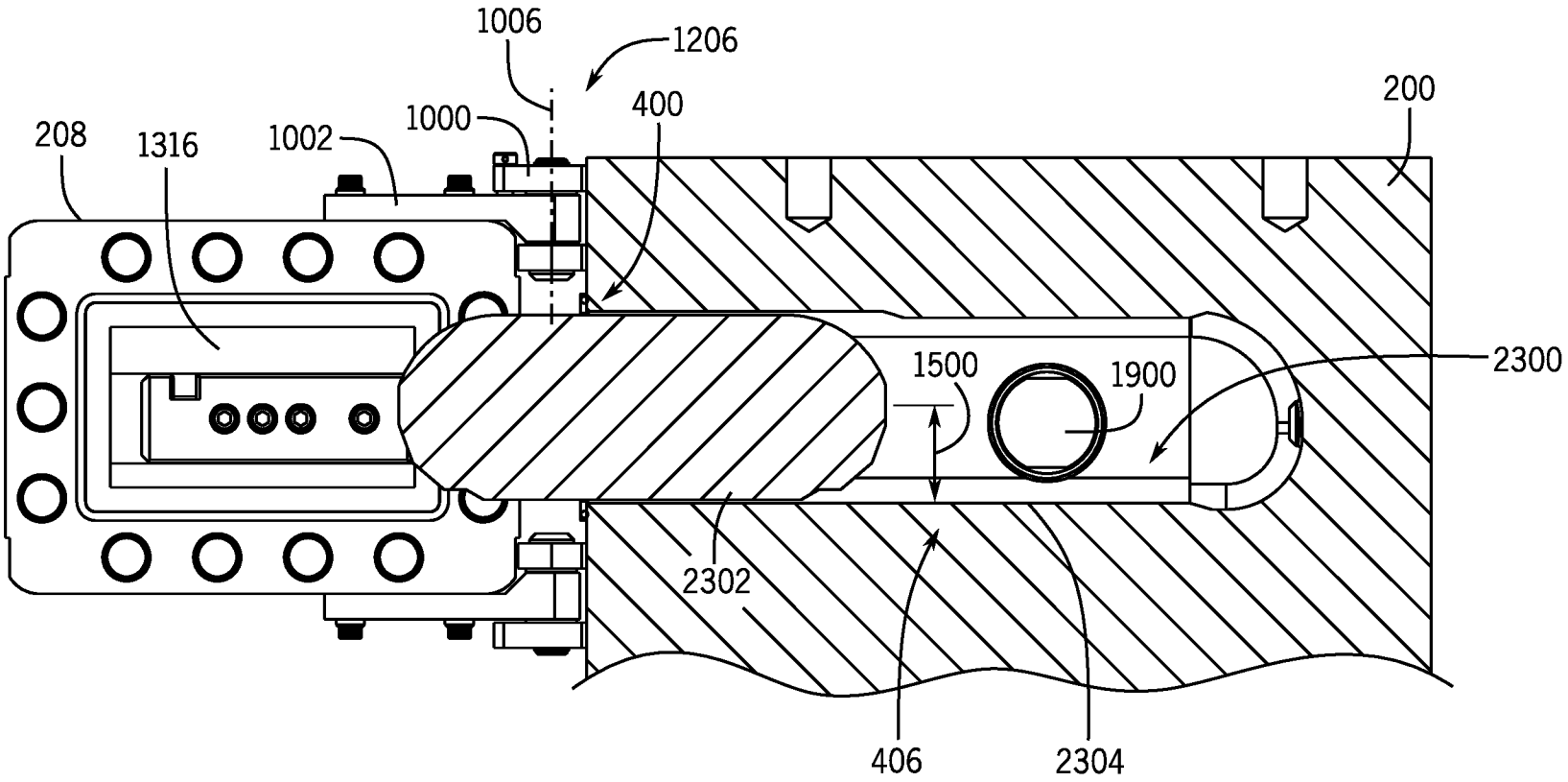
Figure 26:
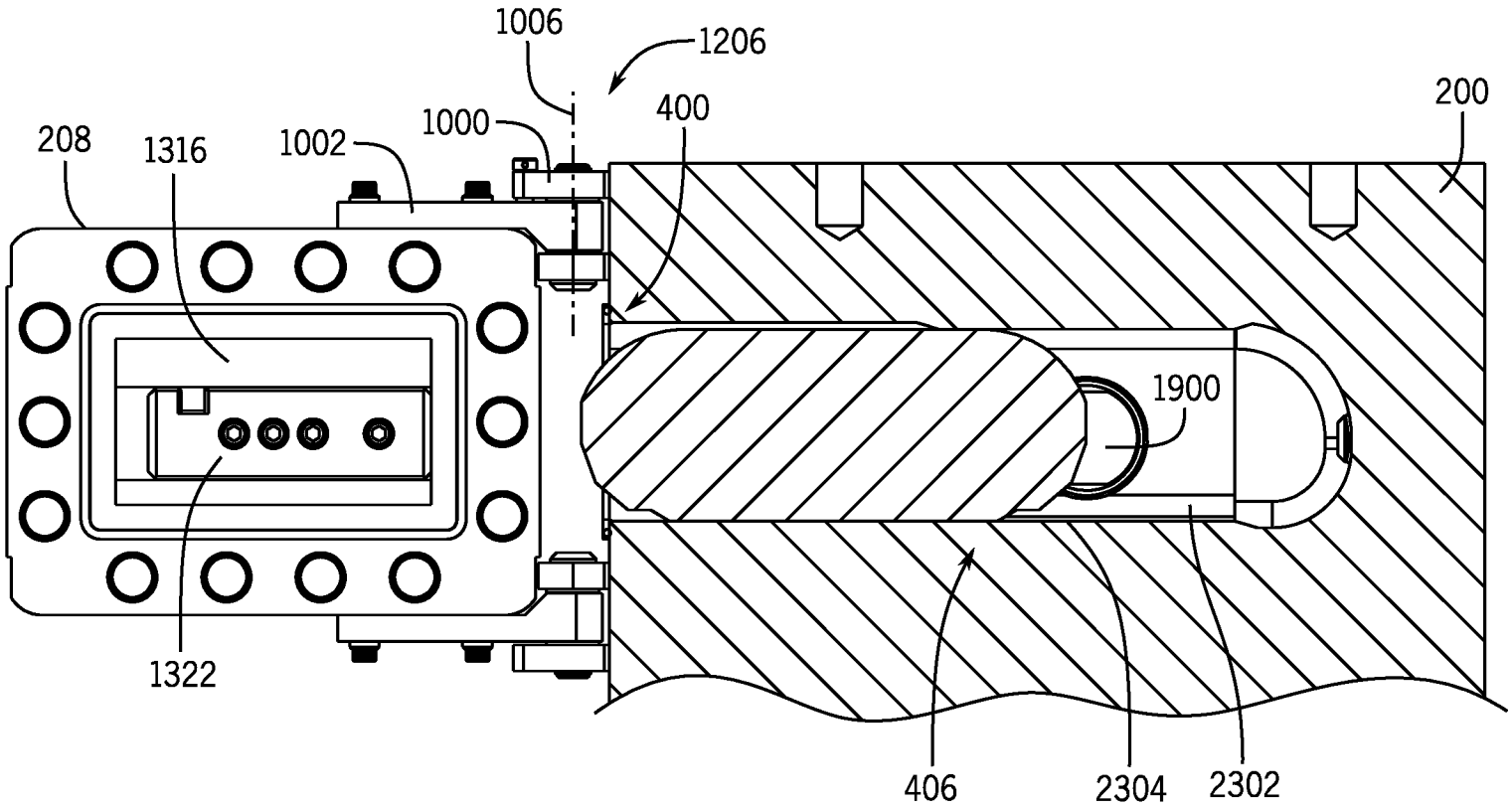
Figure 27:
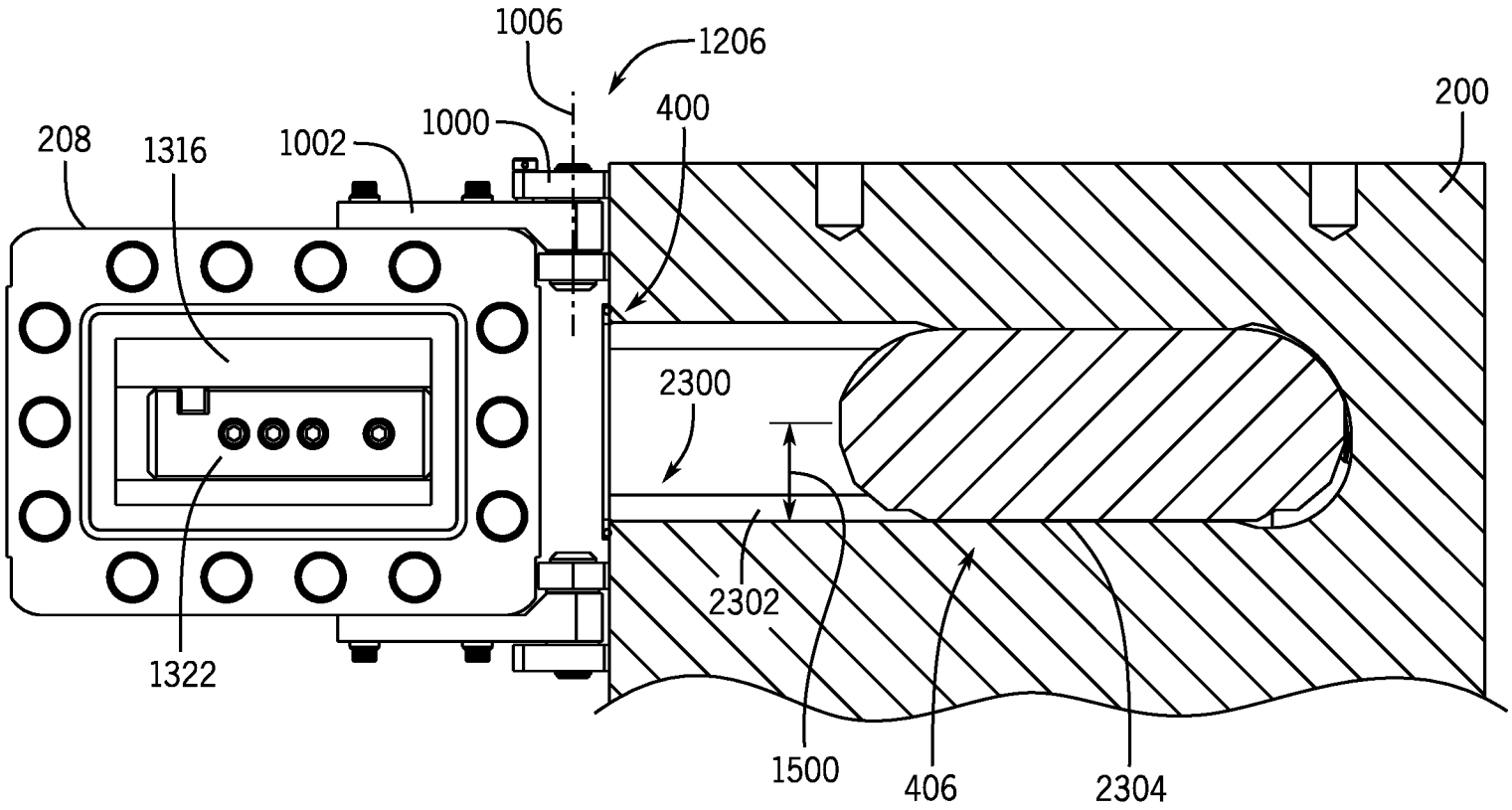

FIG. 24 illustrates the ram block 1600 being moved toward the internal cavity 406 along the T-bar 1322. As the ram block 1600 contacts the body 200, such as at the first portion 2302, at least a portion of the force of the ram block 1600 is transmitted to the body 200. Installation within the internal cavity 406 generates a friction force as the ram block 1600 is driven into position. FIG. 25 illustrates movement of the ram block 1600 into the internal cavity 406. The different in heights between the first portion 2302 and the second portion 2304 is illustrated as a portion of the ram block 1600 hangs over the second portion 2304 without contacting the second portion 2304. In embodiments, the ram block 1600 is still coupled to the door 208, via the T-bar 1322, in the illustrated embodiment. In FIG. 26, the ram block 1600 is no longer connected to the door 208. The piston head 1900 is illustrated as engaging the slot 1602. FIG. 27 illustrates the ram block 1600 arranged within the ram passage 500 and coupled to the piston head 1900. As described above, in various embodiments the ram block 1600 may be further secured to the piston head 1900. In operation, the door 208 may be closed after installation to enable operation of the BOP 116.

Figure 28:
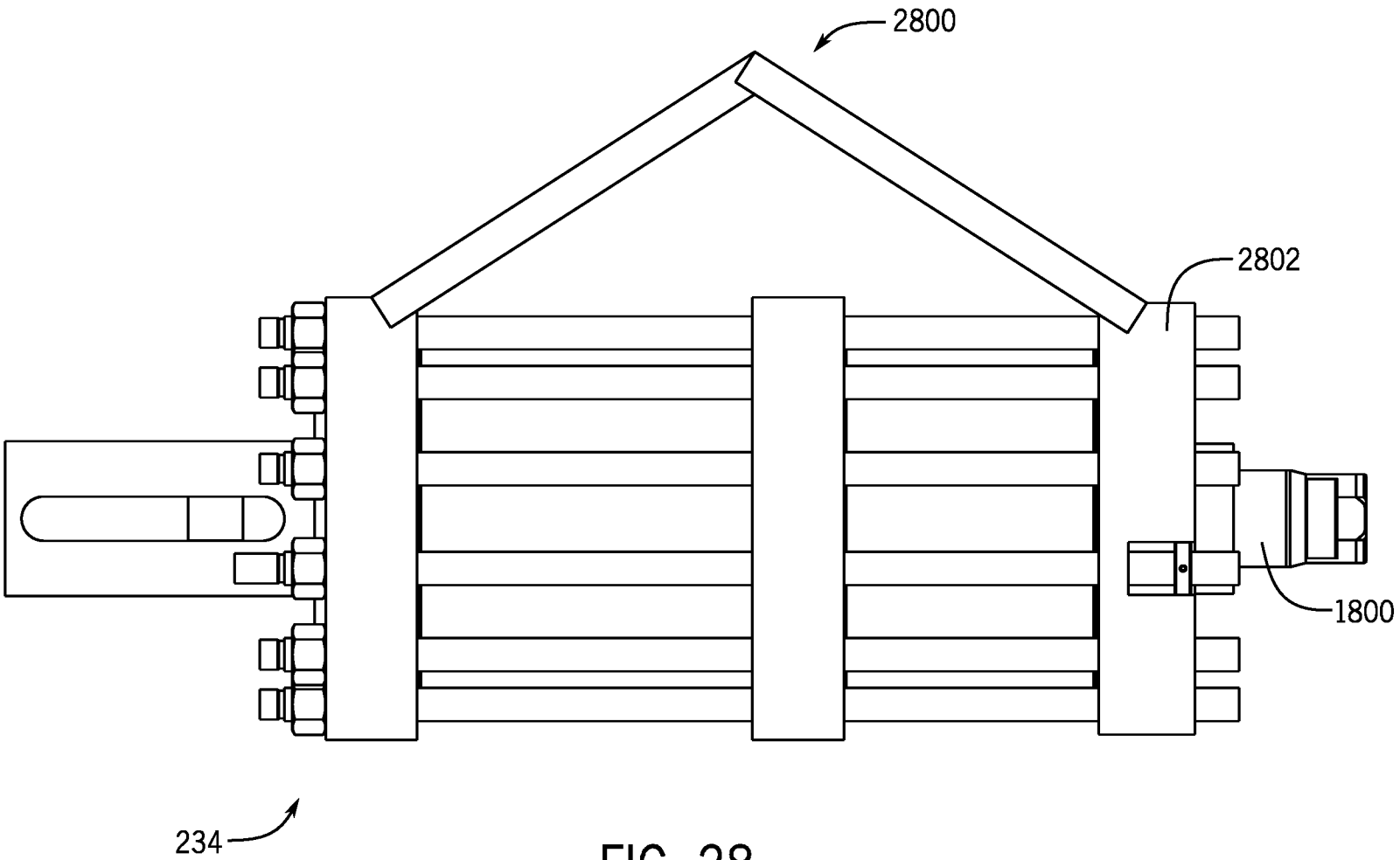
FIG. 28 is a schematic side view of an embodiment of an operator and a lifting mechanism, in accordance with embodiments of the present disclosure.

FIG. 28 is a side elevational view of an embodiment of the operator 234 arranged on a lifting mechanism 2800, which in the illustrated embodiment is a strap. In operation, the operator 234, which may be a hydraulic actuator that drives the piston 1800, may be aligned with the operator opening 404. In embodiments, the operator 234 may be a single or tandem operator. A frame 2802 of the operator may be secured to the body 200, for example via fasteners, as illustrated above.

Figure 29:
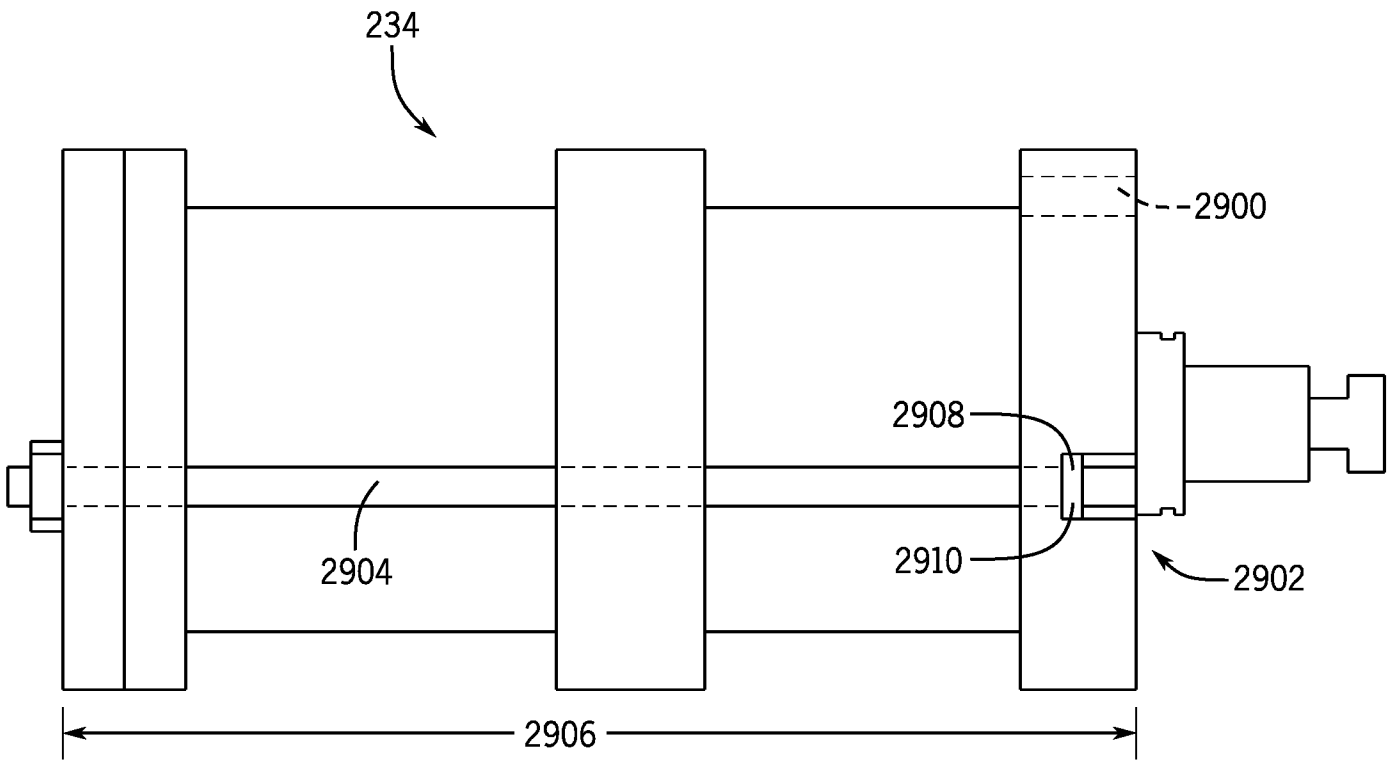
FIG. 29 is a schematic side view of an embodiment of an operator including a position indicator, in accordance with embodiments of the present disclosure.

FIG. 29 is a side elevational view of an embodiment of the operator 234 including an alignment pin 2900 along with coupling confirmation system 2902. In various embodiments, the alignment pin 2900 may be utilized to align the operator 234 to the body 200. For example, the alignment pin 2900 may be an extension that mates with an opening formed in the body 200 to indicate a preferred or predetermined alignment of the operator 234 with respect to the body.

The illustrated coupling confirmation system 2902 includes a rod 2904 extending along a length 2906 of the operator. The rod 2904 may include threaded portions and, in various embodiments, one or more mating features for coupling to an installation tool, such as a wrench or driver. The rod 2904 includes an indicator 2908, arranged proximate an area that will be secured to the body 200. The indicator 2908 includes a nut 2910 in the illustrated embodiment, but it should be appreciated that other indicators may be utilized. In operation, a relative position of the nut 2910 may provide a visual indication that the rod 2904 has been attached to the body 200, thereby securing the operator 234 to the body 200.

Figure 30B:
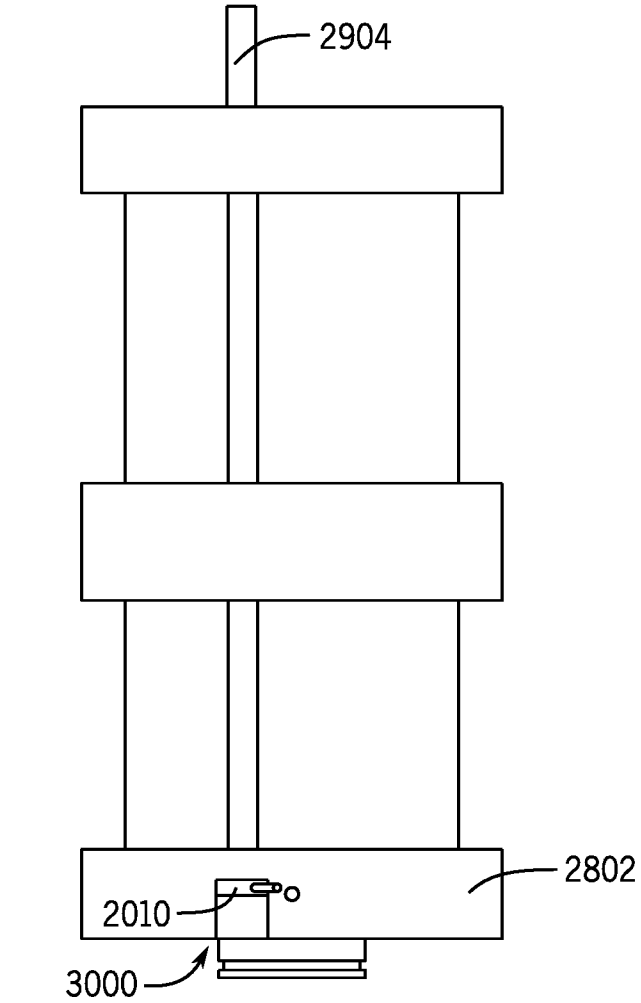
FIGS. 30A and 30B are schematic side views of an embodiment of an operator including a position indicator, in accordance with embodiments of the present disclosure.
Figure 30A:
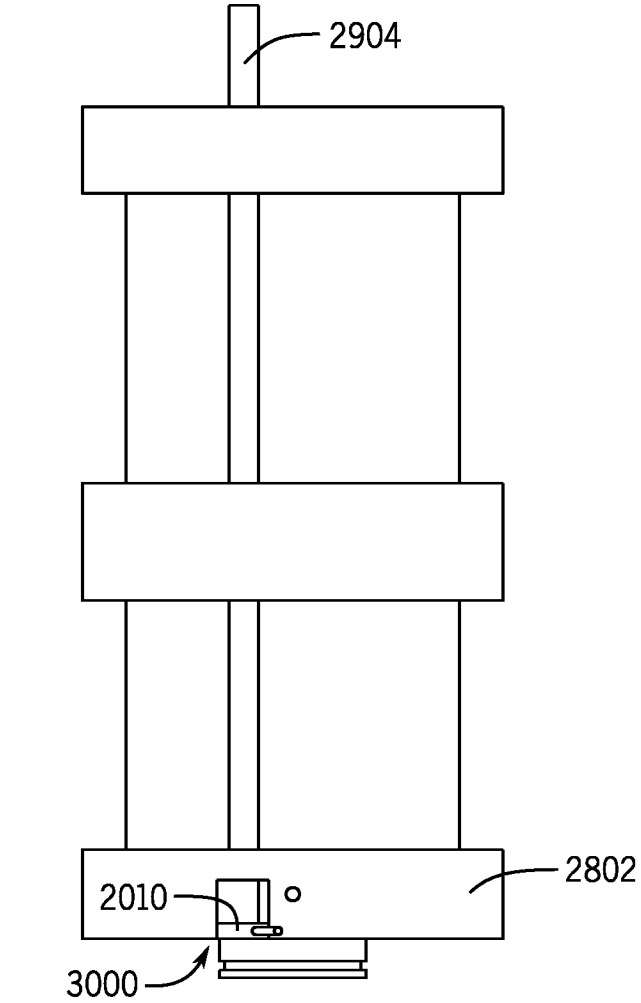

FIGS. 30A and 30B are schematic side views illustrating operation of the coupling confirmation system 2902. In the embodiment illustrated in FIG. 30A, the nut 2010 is visible through an indicator slot 3000 formed in the operator frame 2902. The relative position of the nut 2010 within the indicator slot 3000 provides a visual indication of whether or not the rod 2904 has been secured to the body 200. For example, the position illustrated in FIG. 30A illustrates that the rod 2904 is not assembled into the body 200, while the position illustrated in FIG. 30B illustrates the rod 2904 is assembled into the body 200. That is, the nut 2010 backs off as the rod 2904 is installed. Accordingly, operators may quickly and effectively identify operations in the field to determine whether the operators 234 are operational.

Figure 31:
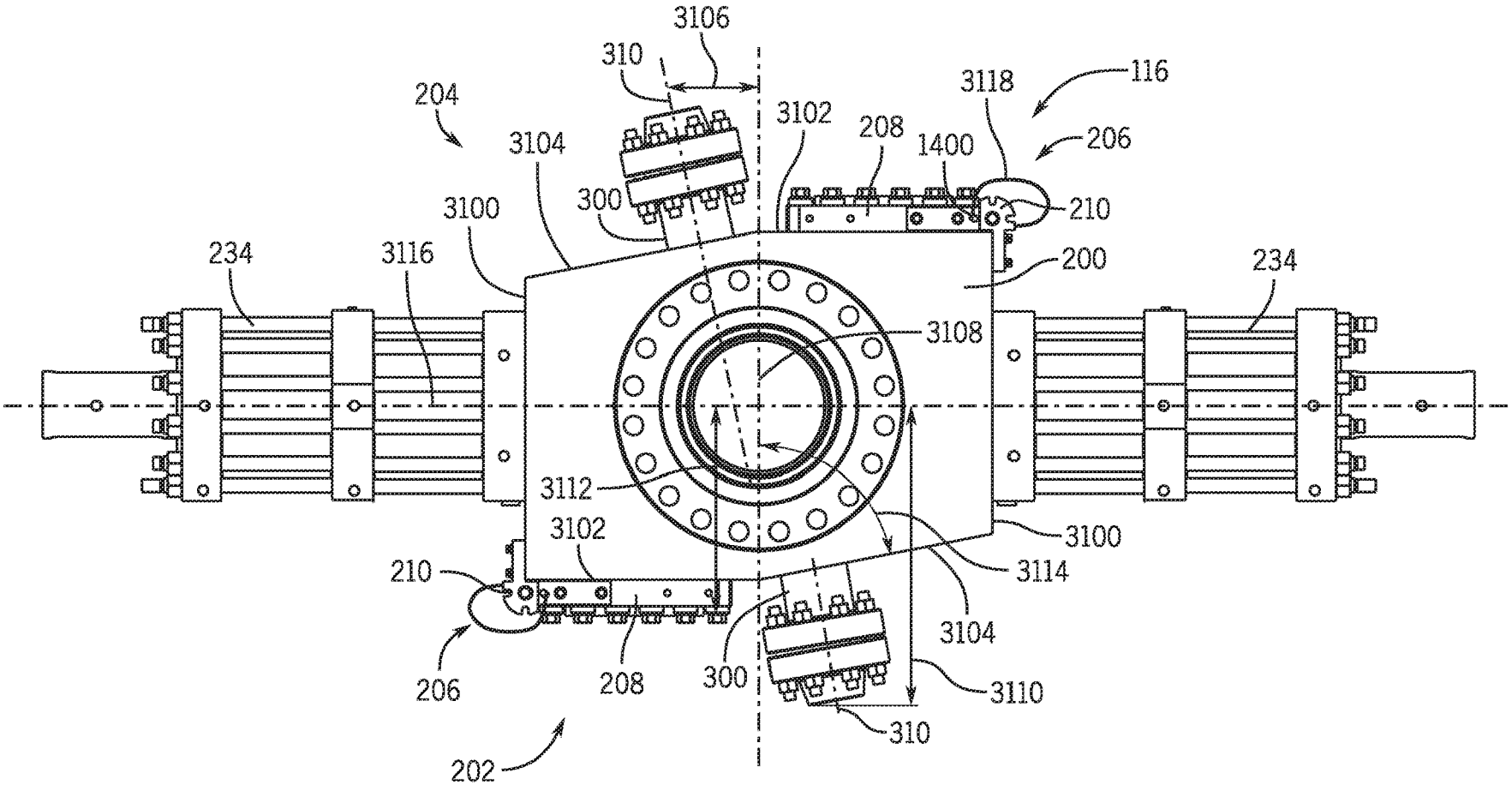
FIG. 31 is a top plan view of an embodiment of a BOP, in accordance with embodiments of the present disclosure.

FIG. 31 is a top plan view of an embodiment of the BOP 116, which may share one or more features with the BOP illustrated herein, such as in FIG. 2. The illustrated BOP 116 includes the body 200 having the front side 202 and the back side 204. As noted above, the terms "front" and "back" are used for illustrative purposes only and that, in various embodiments, different configurations may be deemed the front or back of the body 200. In this example, door assemblies 206 are arranged on both the front and back sides 202, 204 to enable respective doors 208 to rotate about hinges 210 to provide access to an interior chamber of the body 200, as described in detail above.

Further illustrated are the operators 234 coupled to the body 200. As described above, the operators 234 are utilized to transition the ram blocks 1600 between inactive and active positions. The illustrated operators 234 are arranged on planar ends 3100 of the body 200, similar to the configuration shown, by way of example, in FIG. 3. Movement of the ram blocks 1600, as a result, may be substantially perpendicular to the planar ends 3100.

In the illustrated embodiment, each of the front and back sides 202, 204 include the face 224, which may be referred to as a planar face 3102 in various embodiments. Additionally, each of the front and back sides 202, 204 include an angled face 3104, which may be substantially similar to the angled faces 304 illustrated in FIG. 3, in that the angled faces 3104 facilitate coupling of the outlines 300 such that the outlet centerlines 310 are arranged at respective angles 3106 (e.g., the angle 306) from a first plane 3108 of the body 200. Accordingly, as opposed to the configurations shown in FIGS. 2 and 3, the respective door assemblies 206 may be arranged on both the front and back sides 202, 204 of the body 200. In various embodiments, the illustrated embodiment enables maintenance operations on both sides of the body 200 with a reduced likelihood of interference between operations personnel. That is, operations personnel may be separated by a larger distance, thereby reducing the likelihood of interference or other operational impairments. Furthermore, the arrangement of the outlets 300 may provide sufficient clearance for the door assemblies 206 to facilitate rotational movement of the doors 208 to provide access to interior portions of the body 200, as described above.

Embodiments of the present disclosure may position the outlets 300 directly onto the body 200 without the addition of the platforms 302 illustrated in FIG. 3. However, it should be appreciated that the platforms may also be incorporated into the configuration shown in FIG. 31 and that, in various embodiments, the platforms may provide additional material to further strengthen or enhance operational capacity of the BOP 116. In this configuration, the outlets 300 extend an axial distance 3110 that is farther away from the body 200 (e.g., a midpoint of the body 200) than a second axial distance 3112 of the doors 208 (e.g., farther than the exterior face 1404 and/or the stiffener 1402). It should be appreciated that this may enable operators to make connections to the outlets 300 that are clear of a movement plane of the doors 208, which further facilitates multiple crews performing simultaneous maintenance operation on the BOP 116.

In the illustrated embodiment, as noted above, the body 200 includes the planar faces 3102 and the angled faces 3104. The illustrated angled face 3104 is arranged at a face angle 3114 with respect to the first plane 3108. In contrast, the planar face 3102 is arranged at approximately 90 degrees from the first plane 3108. In the illustrated embodiment, the position of the respective angled faces 3104 and planar faces 3102 are offset about the first plane 3108 and about a second plane 3116. That is, each respective side of the planes 3108, 3116 includes one of the planar faces 3102 and one of the angled faces 3104. It should be appreciated that this configuration is for illustrative purposes, and in other embodiments, both of the planar faces 3102 may be on a side of the first plane 3108 and/or both of the planar faces 3102 may be on a side of the second plane 3116, as illustrated in FIG. 3.

In this embodiment, the door assembly 206 is illustrating with a tether 3118 that couples the pin 1400 to the hinge 210. As a result, the likelihood of losing or otherwise misplacing the plan may be reduced. The tether 3118 may be flexible, such as an elastomer, or may be a rigid or semi-rigid component. It should be appreciated that the tether 3118 is provided as one example for maintaining a close relationship between the pin 1400 and the hinge 210, but other embodiments may using different methods, such as sliding features (e.g., where the pin 1400 slides between different positions, a rigidly fastened spring loaded pin, multiple pins that block entry of adjacent pins, or the like).

Figure 32:
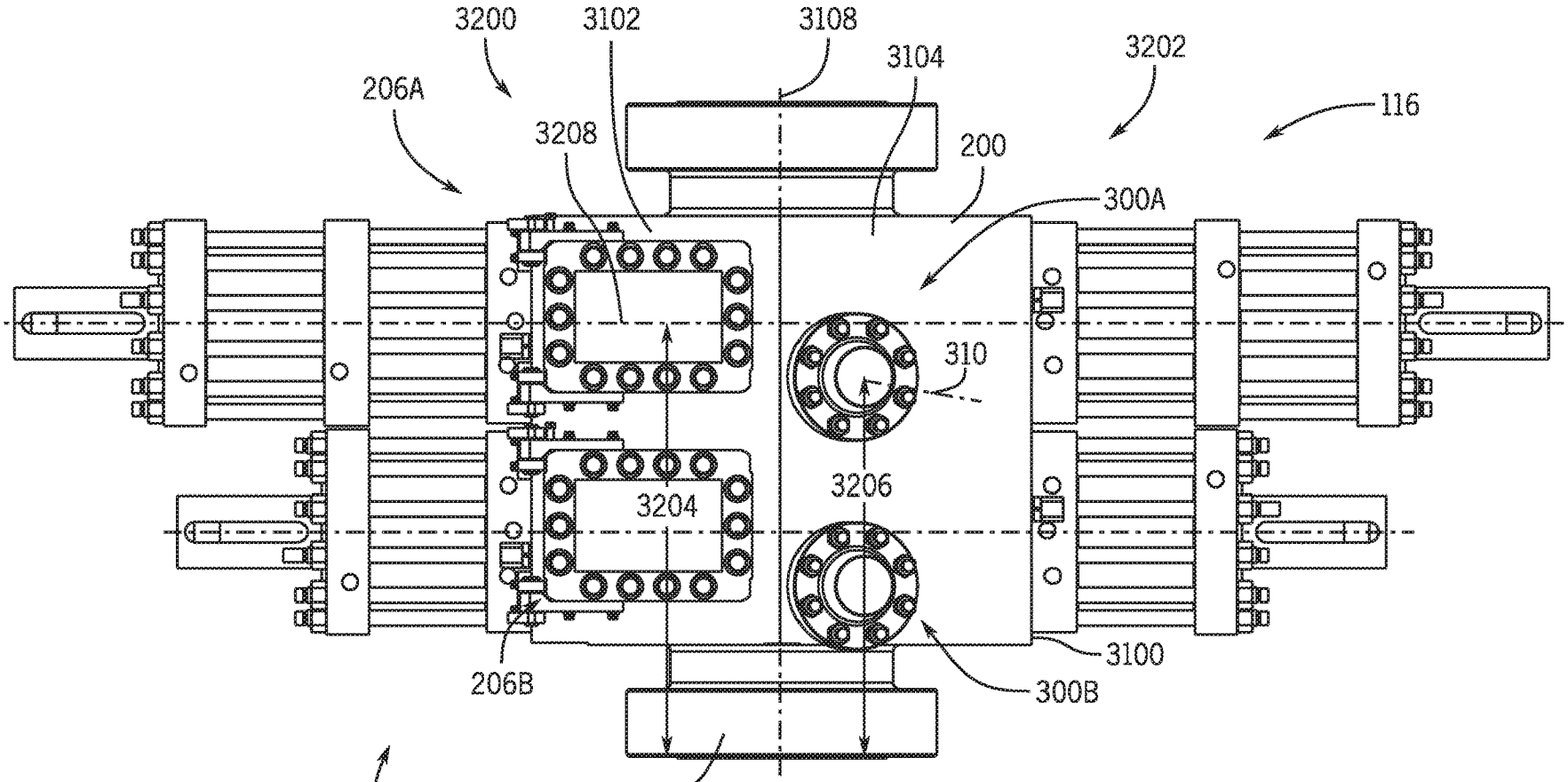
FIG. 32 is a front elevation view of an embodiment of a BOP, in accordance with embodiments of the present disclosure.

FIG. 32 is front elevational view of an embodiment of the BOP 116 illustrating the door assemblies 206 and the outlets 300 arranged on the front side 202 of the body 200. As noted above, various features of FIG. 32 have already been described, such as in FIGS. 2-27, and will not be repeated here. In this embodiment, a first side 3200 (e.g., first half, first portion) includes the door assemblies 206 arranged on the planar face 3102 and a second side 3202 includes the outlets 300 arranged on the angled face 3104. As noted above, this configuration is for illustrative purposes and, in various embodiments, the door assemblies 206 may be arranged on the angled face 3104. In this embodiment, a door vertical height 3204 is greater than an outlet vertical height 3206 for each door assembly 206 and outlet 300 pair. For example, the door assembly 206A and the outlet 300A may be referred to as a pair and the door assembly 206B and the outlet 300B may be referred to as a pair. The door vertical height 3204 refers to a distance from the flange 218 to a door midpoint 3208, which may be substantially aligned with the axis 800 (FIG. 8). The outlet vertical height 3206 refers to a distance from the flange 218 to the centerline 310. Accordingly, each of the door assemblies 206 (e.g., door midpoints 3208) are arranged higher than the outlets 300 for each respective pair. This configuration may provide additional room for the inclusion of equipment and the like. However, it should be appreciated that different configurations may include door vertical heights 3204 that are equal to or less than the outlet vertical heights 3206. Moreover, respective vertical heights 3204, 3206 may not be equal, with one pair having the heights 3204, 3206 being different while another may have the heights 3204, 3206 be different. Accordingly, various configurations may be incorporated within the scope of the present disclosure.

As shown in FIG. 32, the doors 208 may be substantially centered with respect to the planar face 3102, while the outlets 300 (e.g., the outlet centerline 310) are closer to the first plane 3108 than to the planar ends 3100. This configuration may be particularly selected based on the internal geometry of the body 200 and other operational factors. For example, there may be two outlets per cavity in this configuration. It should be appreciated that other configurations may include outlets 300 that are substantially centered on the angled face 310 and/or closer to the planar ends 3100. Furthermore, as noted above, the outlets 300 may be in different positions in different embodiments and may not be aligned as illustrated in FIG. 32.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

What is claimed is:

1. A blowout preventer (BOP) for controlling pressure within a wellbore, comprising:

an internal cavity;

a front side including a door opening, the door opening providing access to the internal cavity;

a door assembly associated with the door opening, the door assembly comprising:

a door, movable between a first position and a second position, the door blocking access to the internal cavity in the first position and enabling access to the internal cavity in the second position;

a hinge coupled to the door to facilitate movement of the door between the first position and the second position; and a coupling device associated with the door, the coupling device securing the door to the front side; and a back side including an outlet, the outlet being fluidly coupled to the internal cavity, wherein the back side is positioned opposite to the front side about a central axis of the internal cavity.

2. The BOP of claim 1, wherein the hinge further comprises:

a hinge body; and a hinge coupling;

wherein the hinge coupling is coupled to the door and the hinge body is coupled to a body of the BOP, the rotation of the door being driven by rotation of the hinge coupling about an axis at an interface between the hinge body and the hinge coupling.

3. The BOP of claim 2, wherein the hinge coupling is secured to the door via receptacles arranged along at least a portion of a perimeter of the door, the receptacles arranged to enable the hinge coupling to be secured to both a first side of the door and to a second side of the door.

4. The BOP of claim 2, further comprising:

a second hinge body; and a second hinge coupling;

wherein the hinge body and the hinge coupling are positioned at a top of the door; and wherein the second hinge body and the second hinge coupling are positioned at a bottom of the door.

5. The BOP of claim 1, wherein the door further comprises a reinforcement feature arranged on an exterior face of the door.

6. The BOP of claim 1, wherein the door assembly further comprises:

an extension extending from an inner face of the door; and a T-bar coupled to a recess of the extension, the T-bar extending along a door axis.

7. The BOP of claim 6, wherein the door further comprises:

a seal groove arranged radially outward of the extension.

8. A blowout preventer (BOP) for controlling pressure within a wellbore, comprising:

an internal cavity;

a front side including a door opening, the door opening providing access to the internal cavity;

a door associated with the door opening, the door being movable between a first position and a second position, the door blocking access to the internal cavity in the first position and enabling access to the internal cavity in the second position; and a hinge coupled to the door, the hinge comprising:

a hinge body, the hinge body secured to a body of the BOP; a hinge coupling coupled to the door; and a rotation mechanism arranged at an interface between the hinge body and the hinge coupling, the rotation mechanism securing the door in the second position or in a third position, the third position enabling access to the internal cavity, wherein the rotation mechanism further comprises:

a body region having a first end and a second end;

a first opening at the first end; and a second opening at the second end;

wherein the first and second openings are configured to receive a pin, the pin engaging the second opening and a receptacle in the hinge coupling, the door being secured in the second position when the pin engages the first opening and in the third position when the pin engages the second opening.

9. The BOP of claim 8, wherein the hinge coupling is secured to the door via receptacles arranged along at least a portion of a perimeter of the door, the receptacles arranged to enable the hinge coupling to be secured to both a first side of the door and to a second side of the door.

10. The BOP of claim 8, further comprising:

a second hinge coupled to the door, the second hinge arranged at a bottom of the door and the hinge arranged at a top of the door.

11. The BOP of claim 8, further comprising:

a plurality of apertures formed in the door, the plurality of apertures configured to align with apertures of the BOP to secure the door to the front side.

12. The BOP of claim 8, wherein the hinge coupling is perpendicular to the front side in the second position.

13. The BOP of claim 8, wherein the hinge coupling is parallel to the front side in the third position.

14. The BOP of claim 8, further comprising:

an outlet extending through a back side, opposite the front side.

15. The BOP of claim 8, wherein the door further comprises:

a T-bar extension extending along a door axis on an inner face of the door.

16. A door assembly for providing access to an internal cavity of a blowout preventer (BOP), comprising:

a door associated with a door opening, the door being movable between a first position and a second position, the door blocking access to the internal cavity in the first position and enabling access to the internal cavity in the second position; and a hinge coupled to the door, the hinge comprising:

a hinge body;

a hinge coupling coupled to the door; and a rotation mechanism arranged at an interface between the hinge body and the hinge coupling, the rotational mechanism securing the door in the second position or in a third position, the third position enabling access to the internal cavity, wherein the rotation mechanism further comprises:

a body region having a first end and a second end; a first opening at the first end; and a second opening at the second end;

wherein the first and second openings are configured to receive a pin, the pin engaging the second opening and a receptacle in the hinge coupling, the door being secured in the second position when the pin engages the first opening and in the third position when the pin engages the second opening.

17. The door assembly of claim 16, wherein the hinge coupling is secured to the door via receptacles arranged along at least a portion of a perimeter of the door, the receptacles arranged to enable the hinge coupling to be secured to both a first side of the door and to a second side of the door.

18. The door assembly of claim 16, wherein the hinge coupling is perpendicular to the front face in the second position and parallel to the front face in the third position.

* * * * *